US006020567A

United States Patent [19]

Ishikawa et al.

[11] Patent Number: 6,020,567

[45] Date of Patent: Feb. 1, 2000

[54] OPERATION APPARATUS OF CIRCUIT BREAKER

[75] Inventors: Yoshinobu Ishikawa; Hiroshi Ohashi, both of Tokyo; Yasuharu Kanai, Yokohama; Makoto Taniguchi, Tokorozawa; Kenji Watanabe, Kawaguchi; Hidetake Shiire, Tokyo, all of Japan

[73] Assignee: Kabushiki Kaisha Toshiba, Kawasaki, Japan

[21] Appl. No.: 09/046,789

[22] Filed: Mar. 24, 1998

[30] Foreign Application Priority Data

| | | | |
|---|---|---|---|
| Mar. 25, 1997 | [JP] | Japan | 9-071932 |
| Jul. 1, 1997 | [JP] | Japan | 9-175785 |
| Mar. 11, 1998 | [JP] | Japan | 10-059557 |

[51] Int. Cl.[7] ..... H01H 3/00

[52] U.S. Cl. ..... 218/154; 218/84; 218/140; 218/120

[58] Field of Search ..... 218/1, 7, 14, 48, 218/49, 57, 65, 78, 84, 92, 118, 120, 140, 154

[56] References Cited

U.S. PATENT DOCUMENTS

| | | | |
|---|---|---|---|
| 2,442,477 | 6/1948 | Wallace et al. | 218/92 |
| 4,086,645 | 4/1978 | Gorman et al. | 218/154 |
| 5,809,157 | 9/1998 | Grumazescu | 335/229 |

OTHER PUBLICATIONS

ABB Leaflet, DEACE 2140–97E, Printed in Germany (07.97–2000–PPI), Jul. 1997.

*Primary Examiner*—Lincoln Donovan
*Attorney, Agent, or Firm*—Oblon, Spivak, McClelland, Maier & Neustadt, P.C.

[57] ABSTRACT

An operation apparatus of a circuit breaker provided with a mobile contact and a fixed contact, the mobile contact is pressed against the fixed contact or drawn apart from the fixed contact, comprising an operation rod fixed to the mobile contact and held to be movable with respect to the fixed contact, a mobile member movably connected to the operation rod, a relative movable range of the mobile member to the operation rod being limited within a predetermined value, a first elastic member for urging the operation rod with respect to the mobile member in a direction in which the mobile contact is pressed against the fixed contact, a fixed member for movably holding the mobile member, a second elastic member for urging the mobile member with respect to the fixed member in a direction in which the mobile contact is drawn apart from the fixed contact, a permanent magnet for driving the mobile member with respect to the fixed member in a direction in which the mobile contact is pressed against the fixed contact, an operation electromagnet for applying a magnet force to the permanent magnet so as to drive the mobile member, and a power supply circuit for energizing the operation electromagnet.

21 Claims, 17 Drawing Sheets

OPERATION APPARATUS OF CIRCUIT BREAKER

BACKGROUND OF THE INVENTION

This invention relates to an operation apparatus for closing/opening, for example, a vacuum circuit breaker having a small capacity, with use of an operation rod.

FIG. 24 shows the conventional operation apparatus of a vacuum circuit breaker. As shown in FIG. 24, a vacuum circuit breaker 93 is held by an upper holder 92 of a switching board 91 which is mounted on a carriage. The vacuum circuit breaker 93 has a mobile contact which is held by an operation rod 94 for operating. The operating rod 94 is provided with an insulating rod 95, and then connected to an operation mechanism provided to the lower portion of the switching board 91.

The operation mechanism comprises an electromagnet 96, a lever 102 provided above the electromagnet 96 and being rotatable with respect to a rotation axis 97, and an iron piece 103 attached to the lever 102 so as to be attracted by the electromagnet 96 when energizing the electromagnet 96. One end of the lever 102 is connected to the insulating rod 95 via a connector 98 and a connecting spring 99, and the other end is connected to a breaker opening spring 100 via a connector 101.

In the operation apparatus constituted as above, when the closing electromagnet 96 is energized, the iron piece 103 is attracted by the electromagnet 96, thereby the lever 102 is rotated in a counter clockwise direction with respect to the rotation axis 97. The rotation force of the lever 102 drives the operation rod 94 upward, thereby the vacuum circuit breaker 93 is closed.

When the closing electromagnet 96 is deenergized, the lever 102 is rotated in a reverse direction by the elastic force of the breaker opening spring 100. The operation rod 94 is thereby driven downward, then the vacuum circuit breaker 93 is opened.

With such a structure of the conventional operation apparatus of a vacuum circuit breaker, however, a large magnetic force needs to be produced to attain the driving force enough to close the vacuum circuit breaker 93. In other words, in order to drive the operation rod 94 to close the breaker 93, the magnet force must be larger than the breaker opening spring 100. The electromagnet 96 thus inevitably needs to be formed large. Further, the electromagnet 96 must be constantly energized when the vacuum circuit breaker 93 is closed. Possibly, the contact pressure between the mobile contact and the fixed contact, is not sufficient.

In order to attain such a large driving force only by the breaker opening spring 100, the electromagnet 96, and the lever 102, the operation mechanism is inevitably so complicated and formed to be large.

BRIEF SUMMARY OF THE INVENTION

The present invention has been developed in consideration of the above-mentioned problems, and intends to provide an operation apparatus of a circuit breaker, which can attain a large contact load with a small driving force and a simple structure.

The present invention has been developed to solve the above-mentioned problems, and has the following features (1)–(6):

(1) The present invention relates to the operation apparatus of a circuit breaker which is provided with a mobile contact and a fixed contact such that the mobile contact is pressed against the fixed contact or drawn apart from the fixed contact, comprises: an operation rod fixed to the mobile contact and supported movably; a mobile member connected to the operation rod so as to move in relation to the operation rod, the relative movable range of the mobile member with respect to the operation rod is limited within a predetermined value; the first elastic member for urging the operation rod with respect to the mobile member in the direction in which the mobile contact is pressed against the fixed contact; a fixed member for movably supporting the mobile member; the second elastic member for urging the mobile member with respect to the fixed member in the direction in which the mobile contact is apart from the fixed contact; a permanent magnet for driving the mobile member in the direction in which the mobile contact is pressed against the fixed contact with respect to the fixed member; an operation electromagnet for applying a magnetic force to the permanent magnet so as to drive the mobile member; and a power supply circuit for energizing the operation electromagnet.

The first and second elastic members are preferably formed of non-linear spring members, and the other components than the permanent magnet and the operation magnet are preferably formed from non-magnetic substances.

It is preferable that the movable scope of the operation rod with respect to the mobile member is set to be smaller than the movable scope of the mobile member with respect to the fixed member. It is also preferable that, where the reaction force applied to the mobile member by the operation rod by virtue of the action of the first elastic member is Fk1, the reaction force applied to the mobile member by the fixed member by virtue of the action of the second elastic member is Fk2, and the attraction force applied to the fixed member by the mobile member is FM when the operation electromagnet is deenergized, the change characteristics of the total sum of the forces Fk1 and Fk2, i.e., Fk1+Fk2 is substantially equal to that of the force FM, within the movable scope of the mobile member.

In this case, the relationship among the forces Fk1, Fk2, and FM is preferably set as FM>Fk1+Fk2 when the mobile contact is intended to be pressed against the fixed contact to close the circuit breaker, and when the mobile contact is intended to be drawn apart from the fixed contact to open the circuit breaker, the relationship is preferably set as FM<Fk1+Fk2.

The permanent magnet and the operation electromagnet may be provided in such a manner wherein the permanent magnet is provided to one of the mobile member and the fixed member, and the operation electromagnet is provided to the other one of the mobile member and the fixed member. Otherwise, both the permanent magnet and the operation electromagnet may be integratedly provided to one of the mobile member and the fixed member and the other one of the mobile member and the fixed member may be provided with a magnetic substance for making the permanent magnet and the operation electromagnet which are integratedly arranged the magnetic forces effect the magnetic force. In the former case, the permanent magnet and the operation electromagnet are preferably arranged in parallel so as to form a closed magnetic circuit.

In such a structure, the recovering forces of the first and second elastic members balance with the permanent attraction force of the permanent magnet when the operation electromagnet is deenergized. The circuit breaker can be therefore easily closed/opened with use of a small operation force applied by the operation electromagnet.

In closing the circuit breaker, the circuit breaker is slowly closed since the attraction force exerted between the operation electromagnet and the permanent magnet is applied in a direction opposite to that of the recovering forces of the first and second elastic members. The circuit breaker closed in this manner is maintained to be closed even if the energization, of the operation electromagnet is stopped, and thus the mobile contact is pressed against the fixed member by the recovering force of the first elastic member.

While, in opening the circuit breaker, the explosion of the breaker opening force can be generated since the repulsion force generated between the permanent magnet and the operation electromagnet is applied in the same direction as that of the recovering forces of the first and second elastic members. Therefore, the opening of the circuit breaker can be performed immediately.

(2) The second elastic member is preferably arranged such that the initial recovering force thereof can be adjusted. The initial recovering force of the second elastic member may be adjusted in such a manner that one end portion of the second elastic member is supported by an adjusting member which is provided to the fixed member or the mobile member such that the arranged position thereof can be adjusted in the moving direction of the mobile member.

With such a structure, the recovering force of the second elastic member can be easily adjusted in view of the characteristics of the permanent magnet.

(3) When the operation apparatus is designed to operate a plurality of circuit breakers, the operation apparatus is provided with at least the operation rods and the first elastic members of the number in accordance with the number of the circuit breakers. It is preferable that the operation apparatus further comprises detecting sensors provided to respective circuit breakers, for detecting the state of the electric current flowing each circuit breaker and a synchronization control circuit for synchronizing the breaker opening timing of each circuit breaker and the timing at which the value of the electric current flowing thereto is set at 0, on the basis of the detection result of the sensor provided to the circuit breaker.

The plurality of the operation rods may be connected to the mobile members of the same number as that of the operation rods through the first elastic member, otherwise, may be connected to the mobile members of smaller number through the first elastic member.

With such a structure, a plurality of circuit breakers can be operated, and can be suitably opened in accordance with the number of the phases.

(4) It is preferable that the manual operation apparatus further comprises a manual breaker opening mechanism which can manually drive the operation rod. The manual operation apparatus may have a driving lever which drives the mobile member by leverage, or may be a magnetic path breaking mechanism capable of manually and mechanically breaking the magnetic path of the permanent magnet.

With such a structure, the breaker opening can be performed even if the operation electromagnet does not work for some reason, and thus the reliability of the apparatus can be improved.

(5) It is also preferable that the operation apparatus of the circuit breaker further comprises a reaction prevention mechanism for preventing the reaction of the mobile member. The reaction prevention mechanism may have a cushion member for reducing the reaction of the mobile member, or a crawl member which to be engaged with the mobile member to restrct the reaction of the mobile member.

With such a structure, the reaction of the mobile member can be effectively prevented, and thus the circuit breaker can perform the circuit opening/closing with reliability.

(6) The operation apparatus of the circuit breaker may further comprises a mobile member driving spring for urging the mobile member in the direction in which the mobile contact is brought into contact with the fixed contact in a condition where the fixed contact and the mobile contact are apart from each other; and a permanent magnet for urging the mobile member in the direction in which the mobile contact is brought into contact with the fixed contact in a condition where the fixed contact and the mobile contact of the circuit breaker are apart from each other.

With such a structure, the same effect as that of (1) can be attained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The first embodiment according to the present invention will be described below with reference to the attached drawings.

[First Embodiment]

Figure 1:
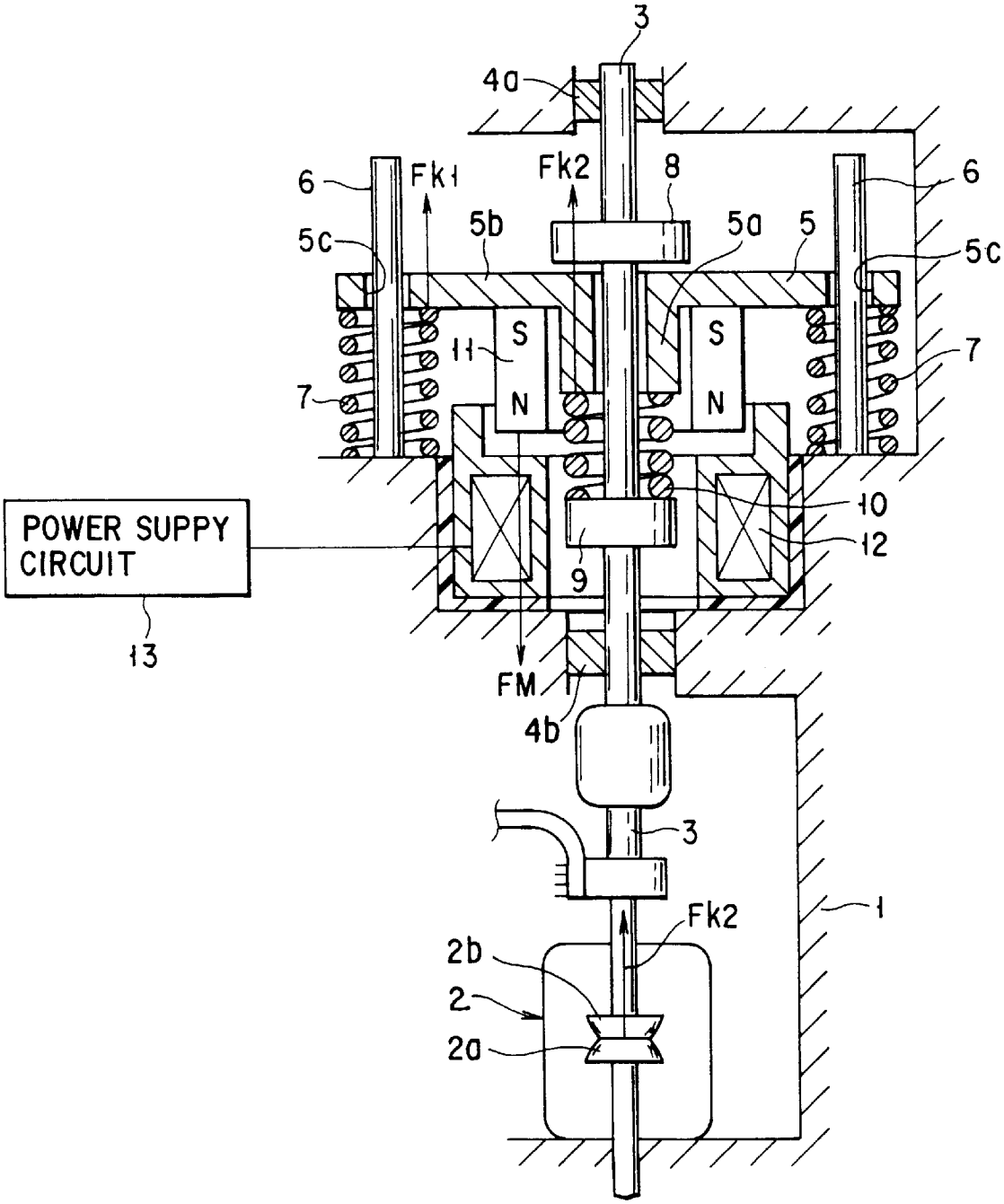
FIG. 1 schematically shows the structure of the operation mechanism of a circuit breaker according to the first embodiment of the present invention.

FIG. 1 is a vertical sectional view of an operation mechanism of a circuit breaker according to the first embodiment.

In FIG. 1, reference numeral 1 denotes a supporting frame (a fixed member) for supporting the circuit breaker and the operation mechanism. The supporting frame 1 is provided with a vacuum circuit breaker 2 having a fixed contact 2*a* and a mobile contact 2*b*. The mobile contact 2*b* of the vacuum circuit breaker 2 is coaxially connected to an operation rod 3 made of an insulating material. The operation rod 3 is supported movably in the axial direction by linear guides 4*a* and 4*b* provided to the supporting frame 1.

In this structure, when the operation rod 3 is driven upward, the mobile contact 2*b* is drawn apart from the fixed contact 2*a* to open the vacuum circuit breaker 2. When the operation rod 3 is driven downward, the mobile contact 2*b* is brought into contact with the fixed contact 2*a* to close the vacuum circuit breaker 2.

The operation rod 3 is provided with a mobile member 5. The mobile member is movably attached to the operation rod 3. The mobile member 5 comprises a cylindrical section 5*a* and a disk section 5*b* attached to the upper end of the cylindrical section 5*a,* and movably provided to the operation rod 3 by inserting the operation rod 3 into the cylindrical section 5*a*. The disk section 5*b* of the mobile member 5 is provided with a plurality of holes 5*c* arranged in a peripheral portion at predetermined intervals in the circumferential direction. The mobile member 5 is attached to the supporting frame 1 by inserting guide pins 6 provided to the supporting frame 1 into the holes 5*c*.

The operation rod 3 is provided with an upper stopper 8 and a lower stopper 9 at the upper and lower portions so as to sandwich the mobile member 5 by themselves, which control the movable range of the mobile member 5. Between the mobile member 5 and the lower stopper 9, a wiping spring 10 (the first elastic members) is arranged for urging the operation rod 3 and the mobile contact 2*b* toward the fixed contact 2*a*.

With this structure, if the mobile member 5 is further driven downward after the mobile contact 2*b* and the fixed contact 2*a* contact with each other, the mobile contact 2*b* is pressed against the fixed contact 2*a* by the recovering force of the wiping spring 10. If the mobile member 5 is further driven upward after the mobile member 5 is brought into contact with the upper stopper 8 of the operation rod 3, the operation rod 3 is driven upward integrally with the mobile member 5.

On the other hand, between the mobile member 5 and the supporting frame 1, mobile member driving springs 7 (the second elastic members) for urging the mobile member 5 upward with respect to the supporting frame 1 are arranged to be put into the guide pins 6, respectively.

The cylindrical section 5*a* of the mobile member 5 is provided with a cylindrical permanent magnet 11 which is put into the cylindrical section 5*a* and fixed to the disk section 5*b* on the lower surface thereof. The supporting frame 1 is provided with an operation electromagnet 12 arranged to face the lower surface of the permanent magnet 11. The operation electromagnet 12 comprises an iron core and a bi-directional solenoid coil. The operation electromagnet 12 can be energized to obtain an attraction force between the permanent magnet 11 and the operation electromagnet 12 enough to close the circuit breaker 2, and can be energized between the permanent magnet 11 and the operation electromagnet 12 to obtain a repulsion force to open the circuit breaker 2, by using the current flowing from the direct power circuit 13 shown in FIG. 1. Further, a permanent magnetic attraction force FM is generated between the permanent magnet 11 and the iron core of the operation electromagnet 12 to press the mobile member 5 downward even when the operation electromagnet 12 is deenergized.

In the operation apparatus having such a structure, the components other than the permanent magnet 11 and the iron core of the operation electromagnet 12 are all made from non-magnetic substance. For example, the supporting frame 1, the operation rod 3, and the mobile member 5 are formed from stainless steel, the mobile member driving springs 7 and the non-linear wiping spring 10 are formed from stainless spring steel, and the solenoid coil of the operation electromagnet 12 and the linear guides 4*a* and 4*b* are formed from copper or copper alloy.

The operation of the operation apparatus will be described below.

Figure 2C:
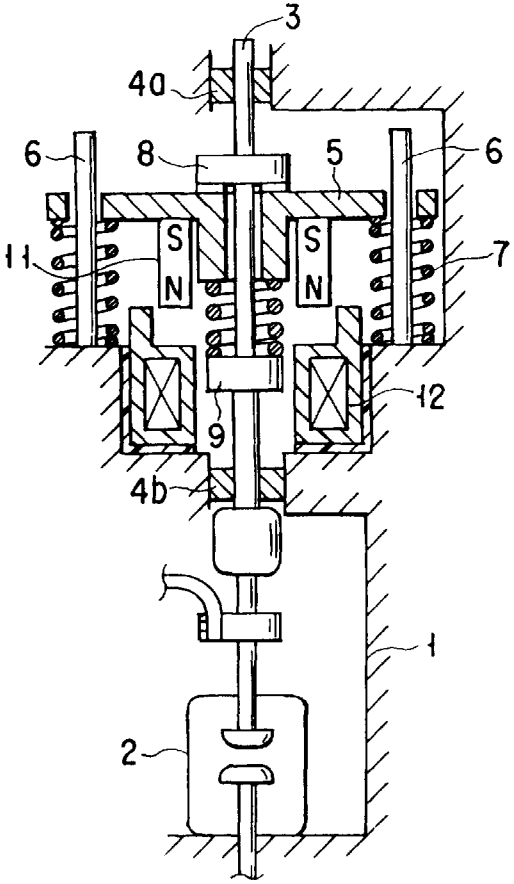
FIGS. 2A, 2B, and 2C show the steps of the closing operation of the mechanism of the circuit breaker according to the first embodiment of the present invention.
Figure 2B:
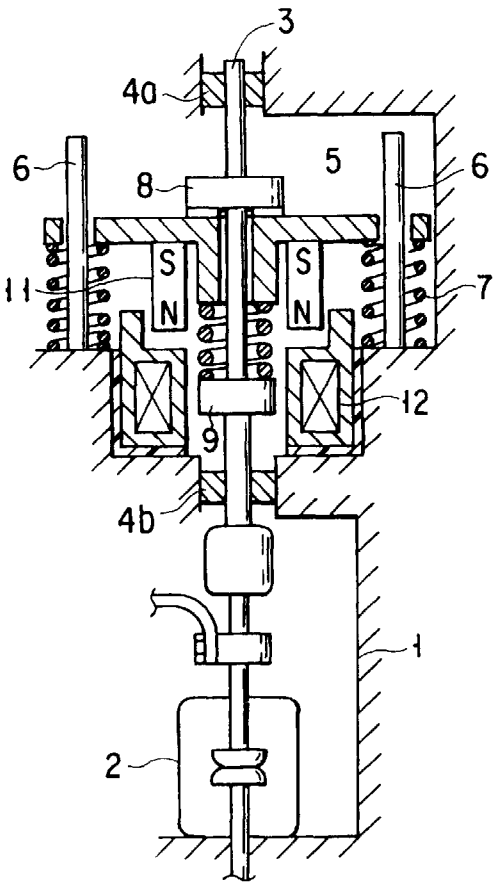
Figure 2A:
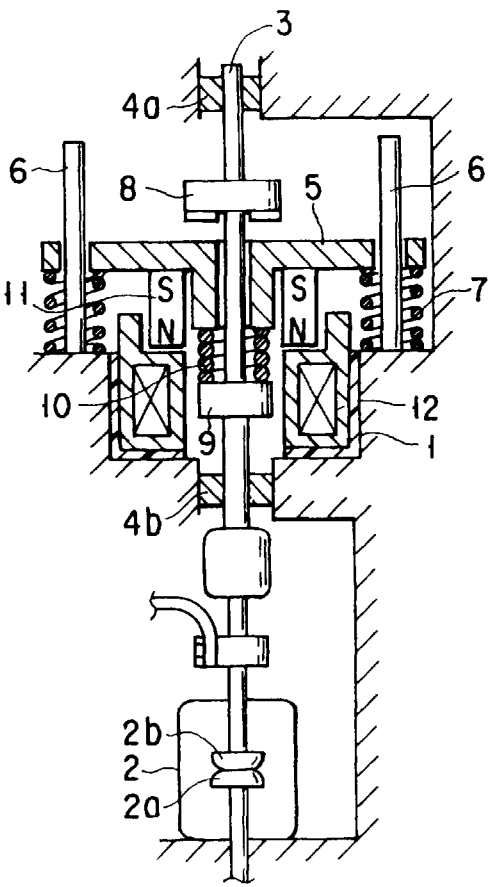

FIGS. 2A, 2B, and 2C show operations of the apparatus.

FIG. 2A shows a state (closing state) in which the wiping spring 10 is compressed, and the mobile contact 2*b* is pressed against the fixed contact 2*a* by the recovering force of the wiping spring 10. FIG. 2B shows the state where the mobile member 5 set in the above-mentioned state is driven upward and brought into contact with the upper stopper 8 of the operation rod 3. If the mobile member 5 is driven further upward, the operation rod 3 is also driven upward, and the mobile contact 2*b* is moved to be drawn apart from the fixed contact 2*a*. FIG. 2C shows the state (opening state) where the mobile contact 2*b* are completely drawn apart from the fixed contact 2*a*.

The forces as shown in FIG. 1 by arrows are respectively denoted as Fk1, Fk2, and FM: the reaction force Fk1 applied to the operation rod 3 from the fixed contact 2*a* in the upward direction by the recovering force of the wiping spring 10; the reaction force Fk2 applied to the mobile member 5 from the supporting frame 1 in the upward direction by the mobile member driving springs 7, and the driving force FM applied to the mobile member 5 by the permanent magnet 11 when the operation electromagnet is deenergized.

Figure 3:
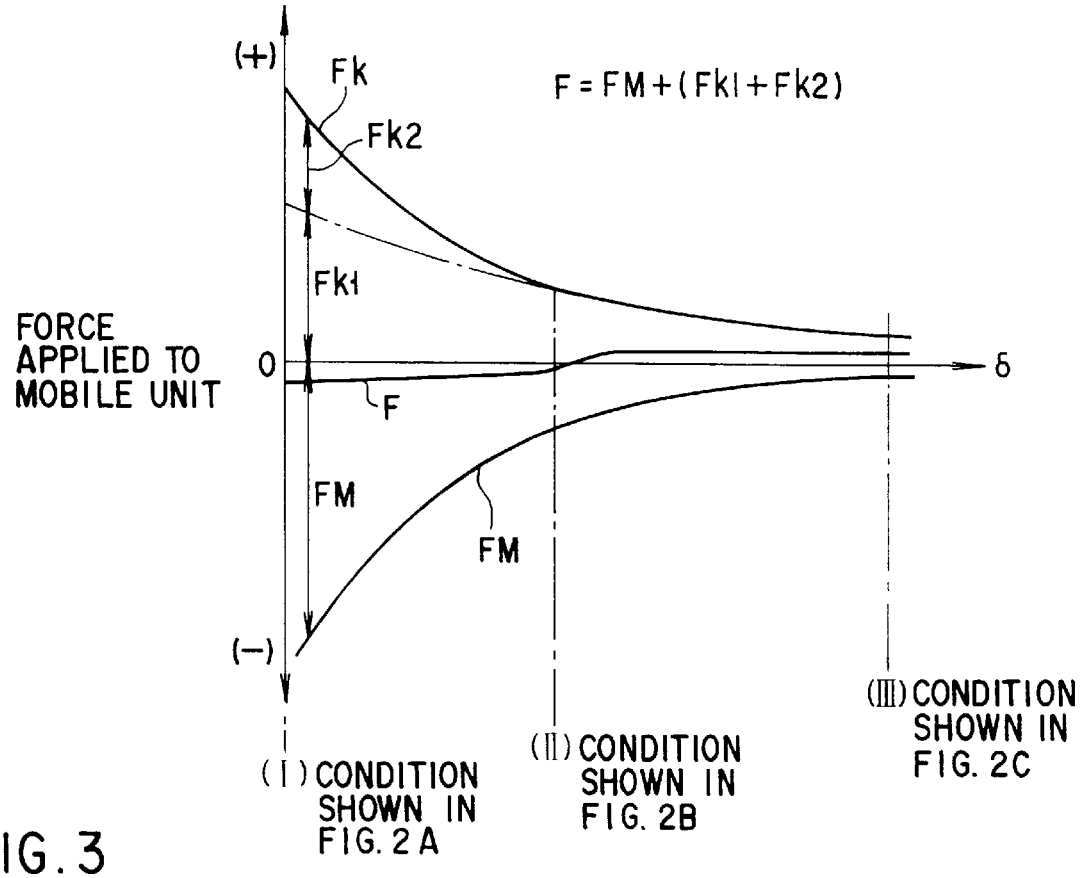
FIG. 3 is a graph showing the relationship between the force applied to the mobile member and the stroke distance of the mobile member according to the first embodiment of the present invention.

The relative movable range of the mobile member 5 with respect to the operation rod 3 is restricted by the upper stopper 8 and the lower stopper 9, and is set smaller than the absolute movable range of the mobile member 5 itself. With this structure, assuming that the force exerted in the upward direction is a positive one, the change of the total spring force FK=Fk1+Fk2 can be drawn as shown in the graph of FIG. 3. In this graph, the state shown in FIG. 2A, is positioned at the origin and the change of the moving distance δ of the mobile member 5 is drawn. The point (I) corresponds to the state shown in FIG. 2A, the point (II) corresponds to the state shown in FIG. 2B, and the point (II) corresponds to the state shown in FIG. 2C. As should be clear from this graph, the total spring force can be represented as FK=Fk1+Fk2 within the area from (I) to (II), and within the area from (II) to (III), the spring force changes to FK=Fk1. It is preferably that the recovering force Fk2 of the wiping spring 10 is quite larger than the recovering force Fk1 of the mobile member driving springs 7.

While, the direction of the permanent attraction force FM of the permanent magnet 11 is the opposite to that of the above-mentioned total spring force FK (in other words, FM has the opposite polarity to that of FK), as shown in FIG. 3, the change characteristics of FM is set to be substantially the same as that of FK. In other words , when the total sum of the forces Fk1, Fk2, and FM is represented as F=FM+(Fk1+Fk2), the value of the force F has maintained is substantially 0, as shown in FIG. 3. To be more precise, FM is set to be a little larger than (Fk1+Fk2) within the area from (I) to (II), in which the force F has the value as F<0, and within the area from (II) to (III), wherein the force F has the value as F>0, FM is set to be a little smaller than (Fk1+Fk2).

Figure 4:
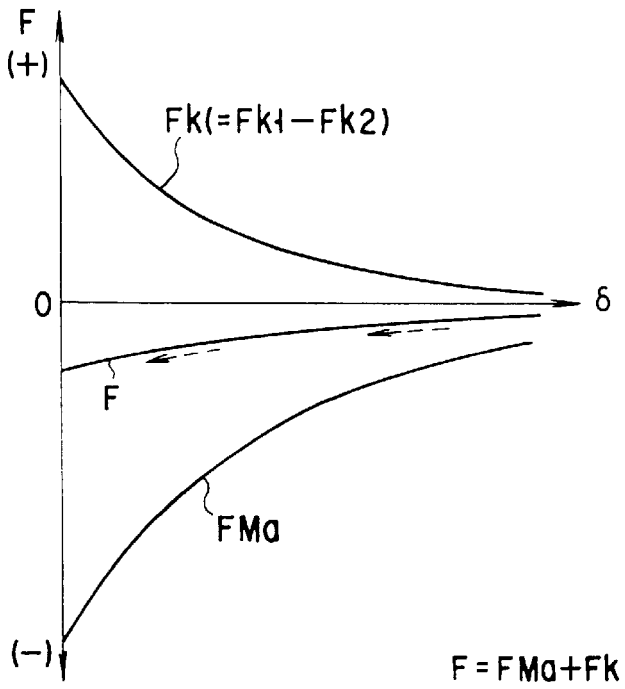
FIG. 4 is a graph showing the relationship between the force applied to the mobile member when the vacuum circuit breaker is closed and the stroke distance of the mobile member according to the first embodiment of the present invention.

Accordingly, in closing the vacuum circuit breaker 2, the operation electromagnet 12 is energized in the state (III) to generate between the permanent magnet 11 and itself an attraction force FMa which is a little larger than the total spring force FK such that the relationship F=FMa+(Fk1+Fk2)<0 is satisfied, as shown in the graph of FIG. 4. If the force FMa is larger than (Fk1+Fk2) even by a little, the vacuum circuit breaker can be closed by operating the mobile member 5, to set the mobile member 5 in the states as shown in FIG. 2C, FIG. 2B, and FIG. 2A, in order. Even if the energization of the operation electromagnet 12 is stopped in the state shown in FIG. 2A, the vacuum circuit breaker 2 can be maintained in the closed state. This is because, the permanent attraction force FM is set to satisfy the relationship FM>(Fk1+Fk2), and thus the mobile contact 2*b* is pressed against the fixed contact 2*a* by the force Fk2 of the wiping spring 10.

Figure 5:
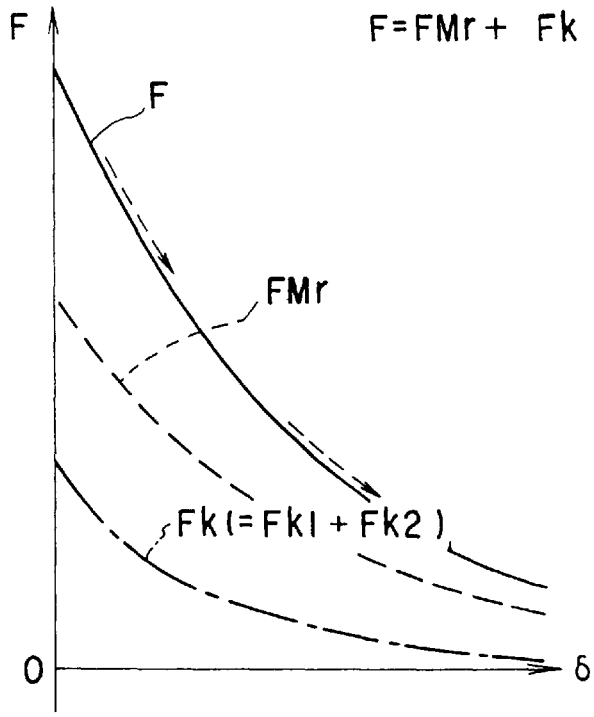
FIG. 5 is a graph showing the relationship between the force applied to the mobile member when the vacuum circuit breaker is opened and the stroke distance of the mobile member according to the first embodiment of the present invention.

In opening the vacuum circuit breaker 2, the operation electromagnet 12 is energized to generate a repulsion force FMr between the permanent magnet 11 and itself. The force FK is exerted in the same direction as that of the force (Fk1+Fk2), and thus the mobile member 5 is applied with only the force in the upward direction. Accordingly, even if the repulsion force FMr is very small, the force F=FMr+Fk1 is very large one as shown in FIG. 5. Therefore, the mobile member 5 is applied with a very large force in the breaker opening direction as if the knocking pins were removed, to immediately reach the position as shown in FIG. 2C. Accordingly, even if the operation electromagnet 12 is deenergized in the state shown in FIG. 2C, the permanent attraction force FM is set as FM<Fk, and thus the vacuum circuit breaker 2 is maintained to be closed.

To sum up, according to the present embodiment, the vacuum circuit breaker 2 can be opened/closed at a suitable speed only by applying a very small force to the mobile member 5.

In the embodiment, a bi-directional solenoid coil is used as the operation electromagnet 12 to perform the attraction-energization and the repulsion-energization (counter energization) by switching the directions in which an electric current flowing from the direct current power supply circuit 13 to the operation electromagnet 12. In the other case, the operation electromagnet having a breaker opening coil and a closing coil may be used as the operation electromagnet 12, instead of the bi-directional solenoid coil.

Figure 6:
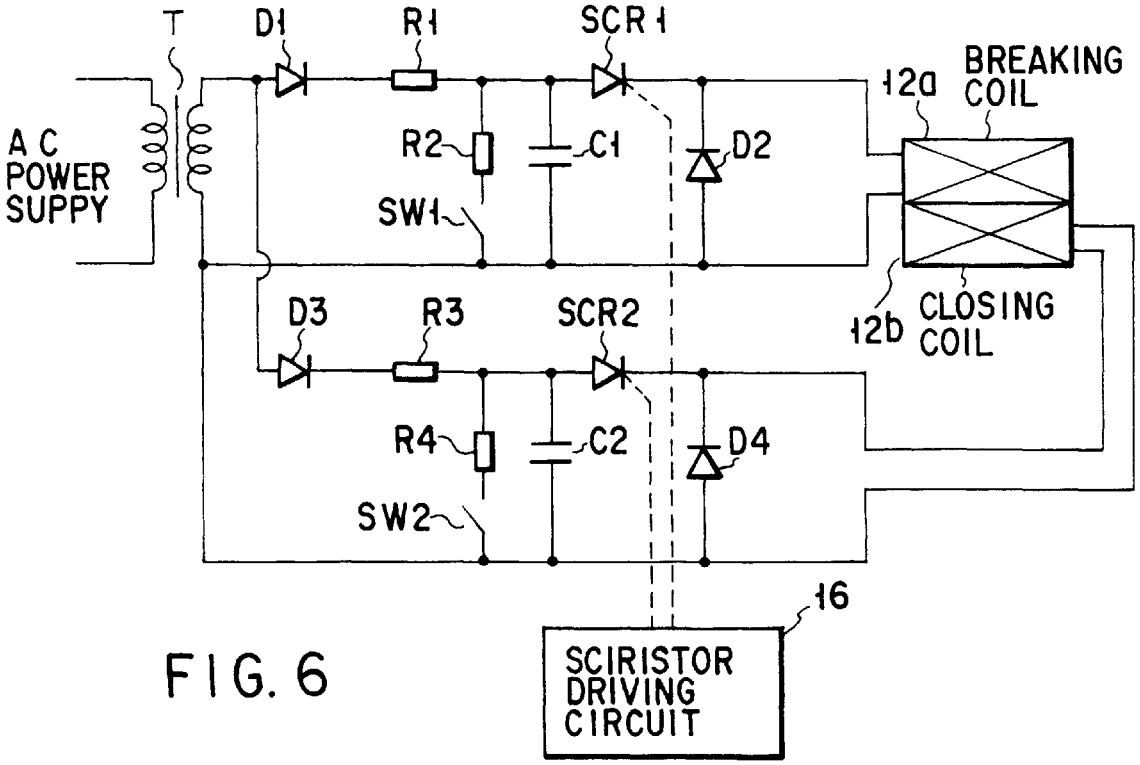
FIG. 6 is a circuit diagram of the power supply circuit when the operation electromagnet having a breaker opening coil and a breaker closing coil is used in the operation apparatus according to the first embodiment of the present invention.
Figure 7:
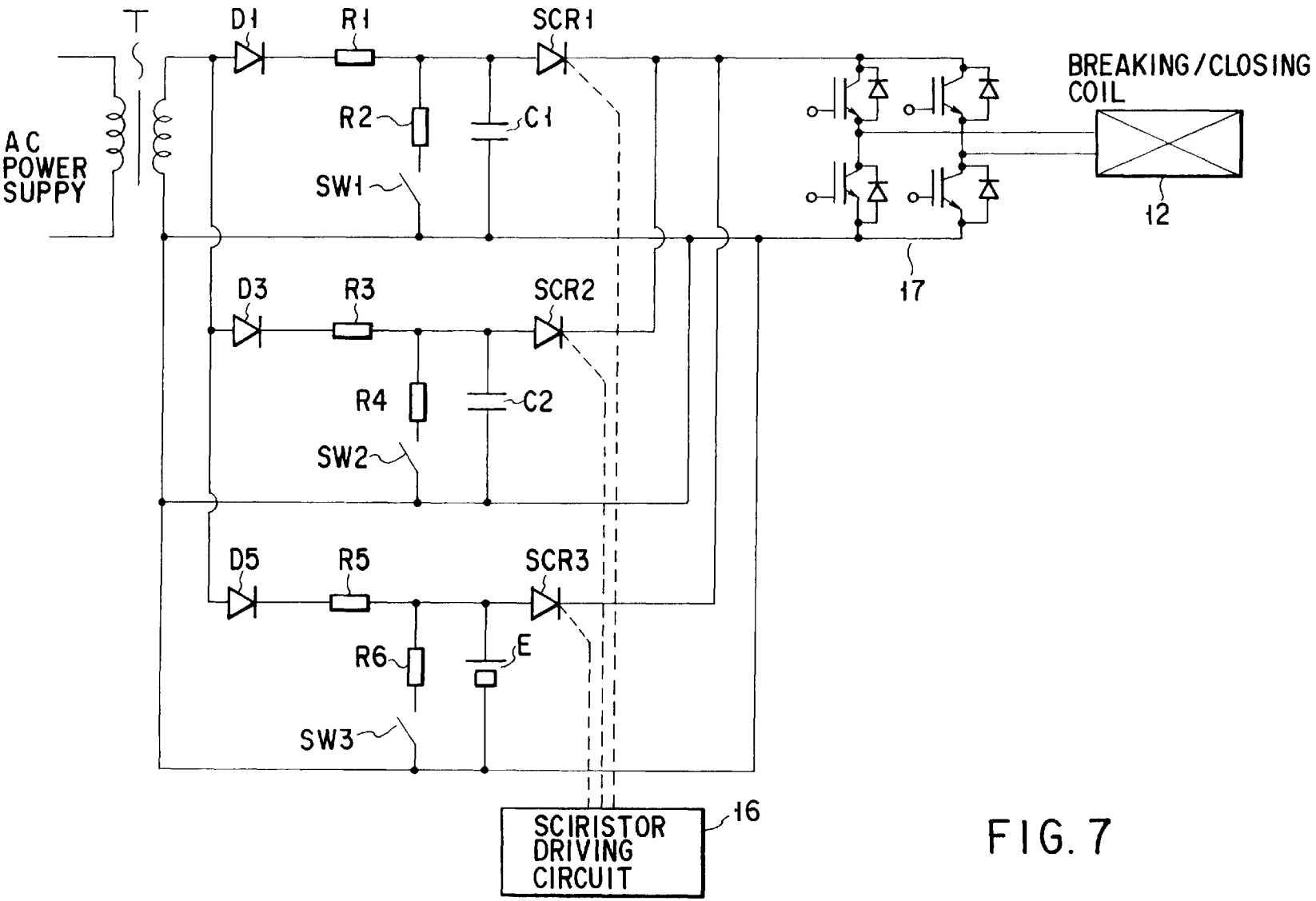
FIG. 7 is a circuit diagram of the power supply circuit when the operation electromagnet having a bi-directional solenoid coil is used in the operation apparatus according to the first embodiment of the present invention.

The descriptions of a power supply circuit 13' used for the operation electromagnet having a breaker opening coil and a breaker closing coil and a power supply circuit 13" used for the operation electromagnet having a solenoid coil will be presented with reference to FIGS. 6 and 7.

FIG. 6 shows an operation electromagnet 12' comprises a breaker opening coil 12*a* and a breaker closing coil 12*b*. The power supply circuit 13 rectifies an alternate current flowing from an alternate current power supply through a transformer T, and then charges a capacitor C1 with the rectified current flowing through a resistance R1. The electric charge stored in the capacitor C1 is applied to the breaker opening coil 12*a* through a scyristor SCR1 triggered by a scyristor driving circuit 16, to magnetize the breaker opening coil 12*a*.

A rectifier D3 constituted as a parallel circuit rectifies an alternate current flowing from the alternate current power supply through the transformer T, and charges a capacitor C2 with the rectified current through a resistance R3. The electric charge stored in the capacitor C2 is applied to the closing coil 12*b* through a scyristor SCR2 triggered by the scyristor driving circuit 16, to magnetize the closing coil 12*b*.

In this circuit diagram, SW1 and SW2 denote switches for discharging, which are connected in parallel via resistances R2 and R4, respectively. D2 and D4 denote diodes provided to prevent the electric current from flowing back through the coils.

The operation electromagnet 12 shown in the circuit diagram of FIG. 7 has a bi-directional solenoid coil.

The power supply circuit 13" shown in this circuit diagram rectifies an alternate current flowing from an alternate current power supply through a transformer T with use of a rectifier D1, and then charges a capacitor C1 with the rectified current flowing through a resistance R1. The electric charge is applied to a switching circuit 17 through a scyristor SCR1 triggered by a scyristor driving circuit 16, to magnetize the bi-directional solenoid coil 12 (circuit opening/closing coil) in the conductive direction (breaker opening/closing direction) which is determined by the switching operation of the switching circuit 17.

In the power supply circuit 13", a rectifier D3 constituted as a parallel circuit of the power supply circuit 13 rectifies an alternate current flowing through the transformer T, and charges a capacitor C2 with the rectified current flowing through a resistance R3. The electric charge is applied to the switching circuit 17 through a scyristor SCR2 triggered by the scyristor driving circuit 16. The two parallel circuits are used when the charging operation needs to be tried again, thereby a swift response can be obtained.

The power supply circuit 13" further comprises a back-up circuit. The back-up circuit rectifies the alternate current flowing through the transformer T in parallel with the above-mentioned two circuits with use of the rectifier D5, and charges a secondary battery E with the rectified current flowing through a resistance R5. The output from the secondary battery E is supplied to the switching circuit 17 through a scyristor SCR3 triggered by the scyristor driving circuit 16 when the supply from the power supply is stopped.

By choosing the power supply circuits 13–13" as described above in accordance with the type of the operation electromagnet 12, the operation electromagnet 12 can be suitably set in a deenergized state, an energized state for closing, or an energized state for repulsion.

SW1, SW2, SW3 denote switches for discharging, which are connected to the capacitors C1 are C2 and the secondary battery E in parallel, via resistances R2, R4, and R6, respectively.

The apparatus of this embodiment is constituted such that the permanent magnet 11 is provided to the side of the mobile member 5, and the operation electromagnet 12 is provided to the side of the supporting frame 1. The same effect obtained by this apparatus can be attained by the apparatus constituted in the opposite manner, i.e., the apparatus wherein the operation electromagnet 12 is provided to the side of the mobile member 5 and the permanent magnet 11 is provided to the side of the supporting frame 1.

Figure 8:
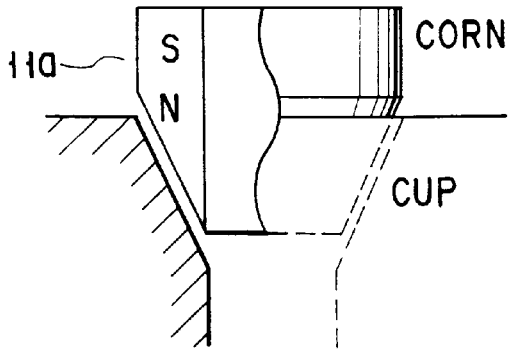
FIG. 8 shows an example of the permanent magnet formed in the other shape than that used in the first embodiment.

Similarly, the cylindrical permanent magnet 11 is used in the first embodiment, but a conical permanent magnet 11' as shown in FIG. 8 can be used instead thereof. In the latter case, the operation electromagnet 12 may be formed in a cup-like shape to correspond to the opposite face of the magnet pole of the permanent magnet 11, as shown in FIG. 8.

Such a conical permanent magnet 11' has not so good deflection-load characteristics in comparing with the case using the cylindrical permanent magnet 11, but can be adjusted by using the mobile member driving spring.

Figure 9A:
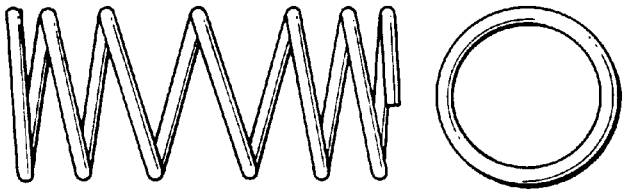
FIGS. 9A, 9B, and 9C are the specific examples of the shapes of the mobile member driving spring and the non-linear wiping spring, and the graph showing the load-deflection characteristics thereof.
Figure 9B:
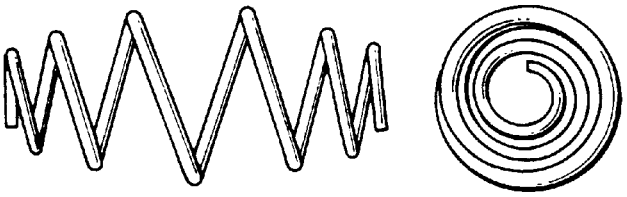
Figure 9C:
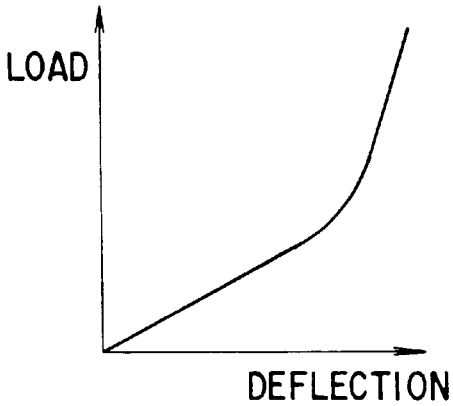

The mobile member driving springs 7 and the wiping spring 10 may be formed in a shape winding as a vine such that the winding is not dense in the central portion, and is dense at both end portions, as shown in FIG. 9A, or otherwise, in a spiral shape as shown in FIG. 9B. The characteristics curve representing the deflection-load characteristics of the springs is non-linear, as shown in FIG 9C.

The non-linear deflection-load characteristics can be also obtained when the mobile member driving springs and the wiping spring 10 is replaced with the serial connection of a plurality of coils-like linear spring which are different from each other in characteristics, or replaced with the coaxial connection of a plurality of coils-like linear spring which are different from each other in diameter.

[The second embodiment]

The second embodiment of the present invention will be described next with reference to FIG. 10. The elements referred to in the description of the first embodiment will be denoted as the same reference numbers, and the detailed description thereof will be omitted here.

Figure 10:
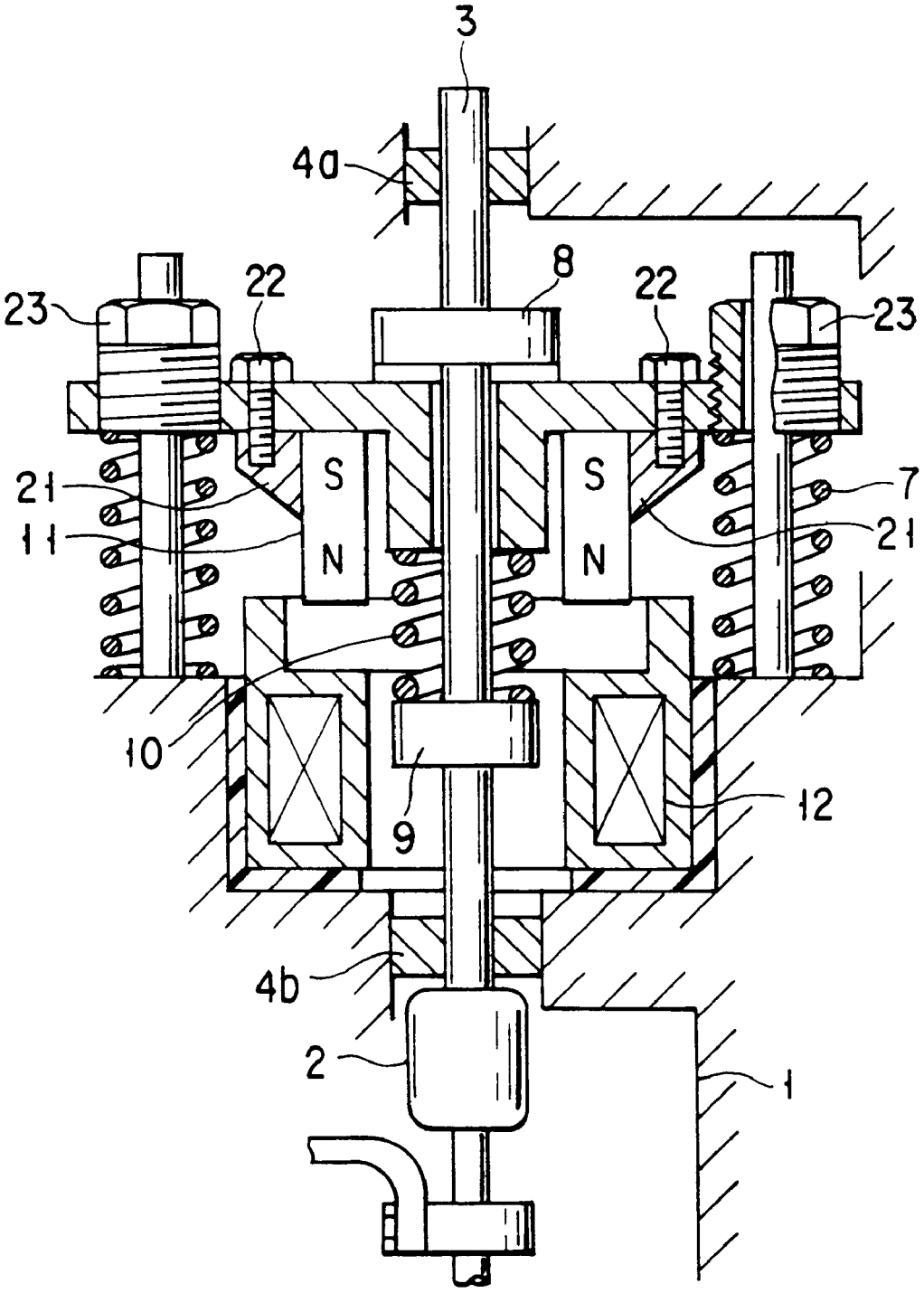
FIG. 10 schematically shows the structure of the operation mechanism of a circuit breaker according to the second embodiment of the present invention.

The operation apparatus according to the second embodiment has a structure wherein the cylindrical permanent magnet 11 is supported by a supporting member denoted as 21 in FIG. 10, and the supporting member 21 is detachably attached to the upper surface of the disk section 5*b* of the mobile member 5 by a screw 22.

On the disk section 5*b* of the mobile member 5, an adjustment screw denoted as 23 in FIG. 10 is screwed. The adjustment screw 23 holds the guide pin 6 slidably in a vertical direction, and holds the mobile member driving springs 7 on its own lower surface.

With such a structure, the permanent magnet 11 can be easily detached from the mobile member 5 by removing the screw 22, and thus operations such as re-magnetizing of the permanent magnet 11 can be performed in maintaining the apparatus.

Further, the recovering force Fk1 of the mobile member driving springs 7 can be adjusted with use of an adjustment screw 23, and thus the total spring force F=(Fk1+Fk2) can be adjusted after the assembling of the operation apparatus.

With this function, the variation of the magnetic force of the permanent magnet 11, which is generated in the manufacturing process, the aged deterioration of the magnetic force of the permanent magnet 11, or the secular change of the characteristics of the wiping spring 10 and the mobile member driving springs 7, can be easily dealt with.

[The third embodiment]

Next, the third embodiment of the present invention will be described below with reference to FIGS. 11A, 11B, and 12.

This embodiment shows the other structure of the magnetic force generating section comprising the permanent magnet and the operation electromagnet. In order to improve the characteristics attained by the first embodiment, it is preferable to modify the shape of the magnetic force generating section.

Figure 11A:
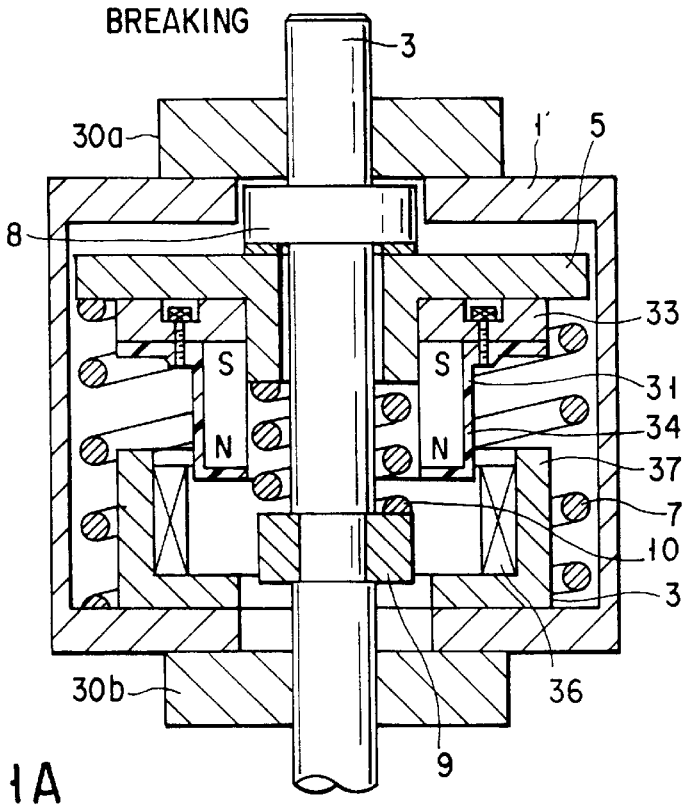
FIGS. 11A and 11B schematically show the structure of the operation mechanism of a circuit breaker according to the third embodiment of the present invention.
Figure 11B:
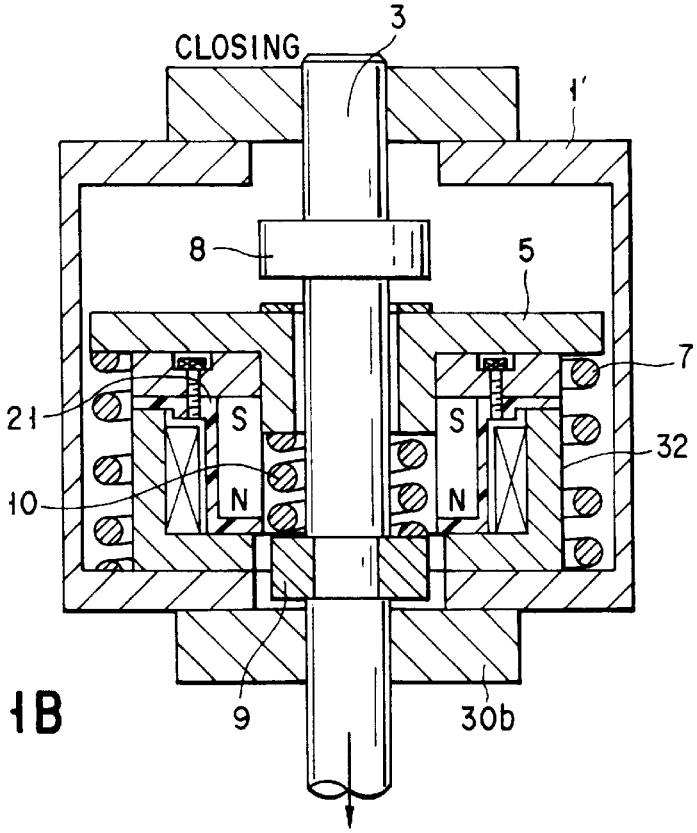

FIGS. 11A and 11B show a part of the operation apparatus shown in FIG. 1, wherein only the mobile member and the peripheral members are shown, and the elements referred to in the first embodiment will be denoted by the same reference numbers as those in FIG. 1. In this embodiment, the supporting frame 1' is formed in a box-like shape, and the operation rod 3 is supported slidably in a vertical direction by linear guides 30*a* and 30*b* for closing the upper and the lower openings of the box-like supporting frame 1'. FIG. 11A shows a condition when the vacuum circuit breaker 2 is opened, and FIG. 11B shows a condition when the vacuum circuit breaker 2 is closed.

Figure 12:
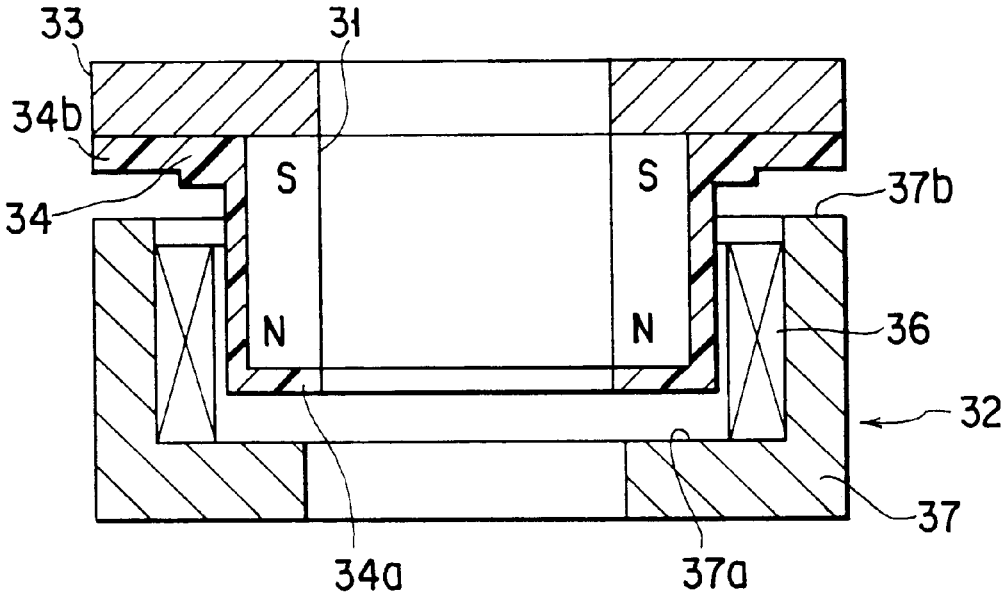
FIG. 12 is the sectional view showing one structure of the permanent magnet and the operation electromagnet incorporated into the operation apparatus of the circuit breaker according to the third embodiment of the present invention.

FIG. 12 specifically shows a permanent magnet 31 attached to the mobile member 5, and an operation electromagnet 32 which make the permanent magnet 31 attached to the supporting frame 1' generate an attraction force or a repulsion force.

The permanent magnet 31 is formed in a cylindrical shape, and has an upper surface on which a disk-like yoke 33 is fixed. The permanent 31 is covered with a non-magnetic substance cover 34 fixed to the disk-like yoke 33, at the outer periphery thereof. A cover section 34*a* covering the lower surface of the permanent 31 and a cover section 34*b* covering the lower surface of the yoke 33 function as the magnetic force of the permanent magnet 31.

The operation electromagnet 32 comprises a cylindrical solenoid coil 36 which is arranged to face the outer periphery of the non-magnetic substance cover 34, and a cup-like shape iron core 37 for supporting the solenoid coil 36 on the inner surface thereof. In this time, an upper surface section 37*a* of the iron core 37, which faces the lower surface of the permanent magnet 31, and an upper surface section 37*b* of the iron core 37, which faces the lower surface of the yoke 33, function as the pole face of the operation electromagnet 32.

In this apparatus constituted as above, the magnet force lines of the permanent magnet 31 pass through the iron core 37 of the operation electromagnet 32, and thus the permanent magnet 31 attracts the iron core 37 with a large magnetic force. According to this structure, the permanent magnet 37 of the present embodiment can generate a larger permanent attraction force FM in comparing with the structure described in the first embodiment even if the permanent magnet 37 has the same size and characteristics as described in the first embodiment. The apparatus thus can be provided with the mobile member driving springs 7 or the wiping spring 10 having a larger recovering force in comparing with that in the first embodiment since the permanent magnet 37 has larger attraction force, and thus the breaker opening force or closing force can be increased. Further, according to this structure, a margin can be ensured between the magnetic attraction force and the recovering forces of the springs 7 and 10 thereby the error due to the reduction of the magnetic force of the permanent magnet 37 can be prevented from occurring.

Most of the magnetic force lines pass through the inside of the iron core 37, and inside the solenoid coil 36, pass in the axial direction with a uniform flux density. Accordingly, when the operation electromagnet 32 is energized, the operation electromagnet 32 applies the permanent magnet 31 with an attraction force or a repulsion force with a long stroke.

Accordingly, the absolute movable range of the mobile member 5 can be increased, and thus the adjusting range of the mobile member driving springs 7 is widen to make the adjustment thereof easy.

Figure 13:
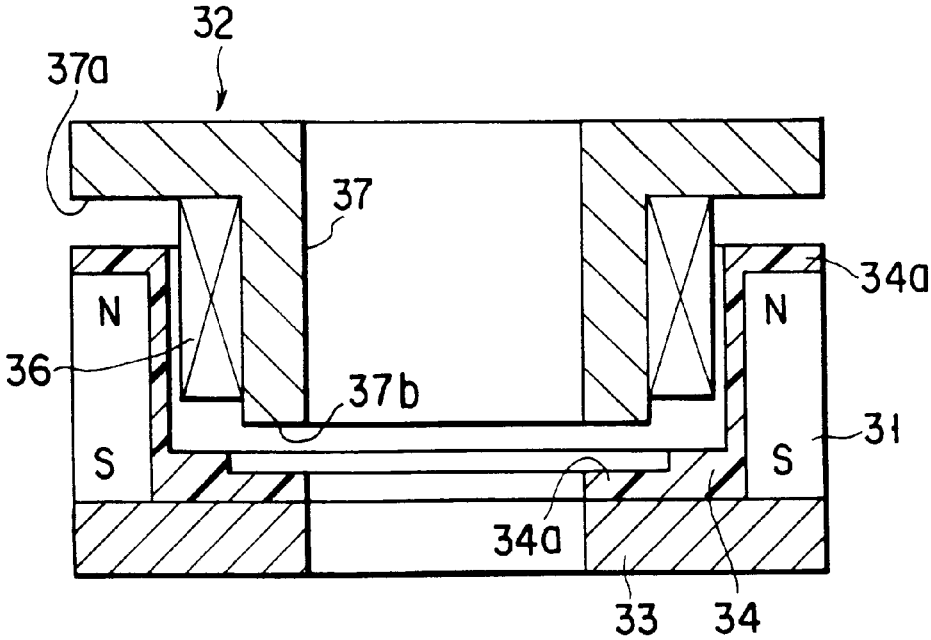
FIG. 13 is the sectional view showing another structure of the permanent magnet and the operation electromagnet incorporated into the operation apparatus of the circuit breaker according to the third embodiment of the present invention.

FIG. 12 shows the apparatus having the permanent magnet 31 arranged inside the solenoid coil 36. The permanent magnet 31 may be arranged outside the solenoid coil 36, as shown in FIG. 13.

[The fourth embodiment]

Figure 14:
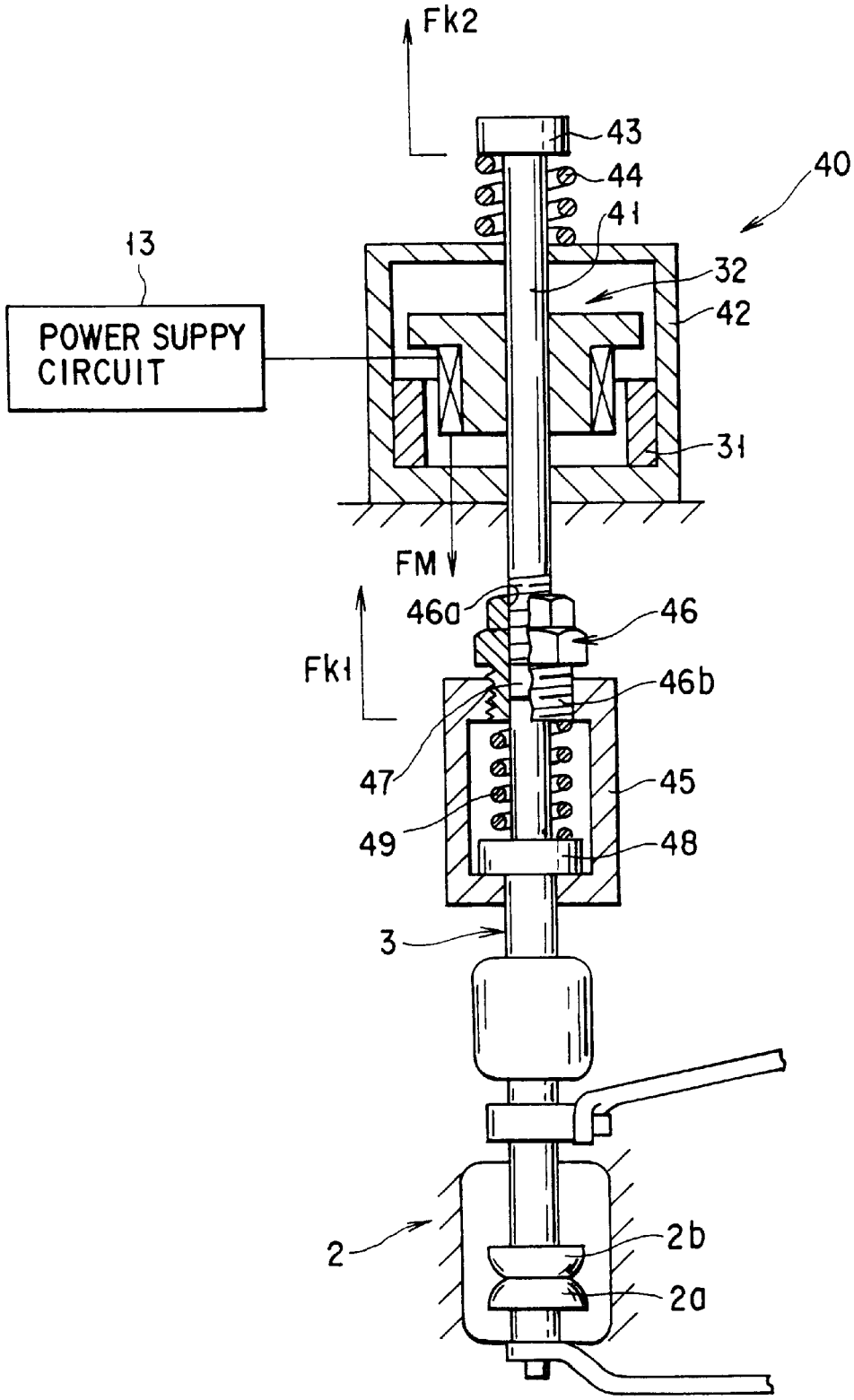
FIG. 14 schematically shows the structure of the operation mechanism of a circuit breaker according to the fourth embodiment of the present invention.

The fourth embodiment of the present invention will be described next, with reference to FIG. 14.

This embodiment relates to the other arrangement of the wiping spring 10, mobile member 5, driving spring 7 or the others. The elements described in the first embodiment will be denoted by the same reference numerals as in the first embodiment, and the detailed description thereof will be omitted here.

An operation apparatus 40 has a mobile member denoted as a numeral 41. The mobile member 41 is formed in a rod-like shape, and held slidably in the vertical direction by upper and lower linear guides (not shown) provided to a supporting frame 42.

At the upper end portion of the mobile member 41, the first stopper 43 is arranged, and a mobile member driving spring 44 is inserted between the first stopper 43 and the supporting frame 42. As should be clear from this structure, the mobile member 41 is constantly pressed upward by the mobile member driving spring 44.

The lower end portion of the mobile member 41 is provided with an operation rod supporting case 45 for supporting the upper end portion of the operation rod 3 movably in the vertical direction, the operation rod supporting case 45 is fixed to the lower end portion of the mobile member 41 via a connecting member 46. The connecting member 46 is fixed to the lower end portion of the mobile member 41 by a female screw section 46*a* formed in the upper portion of the connecting member 46, and is fixed (e.g., screwed) to the operation rod supporting case 45 by a male screw section 46*a* formed in the lower portion of the connecting member 46.

The lower portion of the connecting member 46 is further provided with a guide hole 47 arranged coaxially with the female screw section 46*b,* and the upper end portion of the operation rod 3 is inserted into the guide hole 47 so as to freely protrude therefrom. In the middle section of the operation rod 3, the second stopper 48 for controlling the movement of the operation rod 3 is provided. Between the upper surface of the second stopper 48 and the lower end surface of the connecting member 46, a wiping spring 49 is inserted to press the operation rod downward.

The supporting frame 42 is provided therein with the operation electromagnet 32 fixed to the mobile member 41 and the permanent magnet 31 fixed to the supporting frame 42 so as to face the operation electromagnet 32 (see the structure shown in FIG. 13). The operation electromagnet 32 is connected to the power supply circuit 13 so as to be energized to generate a repulsion force or an attraction force.

Also with such a structure, substantially the same effect as that of the first embodiment will be attained by setting the permanent attraction forces (Fk1, Fk2, and FM) of the mobile member driving spring 44, the wiping spring 49, and the permanent magnet 31 in the similar manner to that of the first embodiment.

Further, in this structure, the wiping spring 49 can be arranged near the vacuum circuit breaker 2, and thus the operation rod 3 can be formed short. The total weight of the operation rod 3 and the mobile contact 2*b* can be therefore decreased to reduce the inertia generated by in the operation of the apparatus. By virtue of this feature, the vacuum circuit breaker 2 can be opened at a high speed and with reliability.

[The fifth embodiment]

Figure 15:
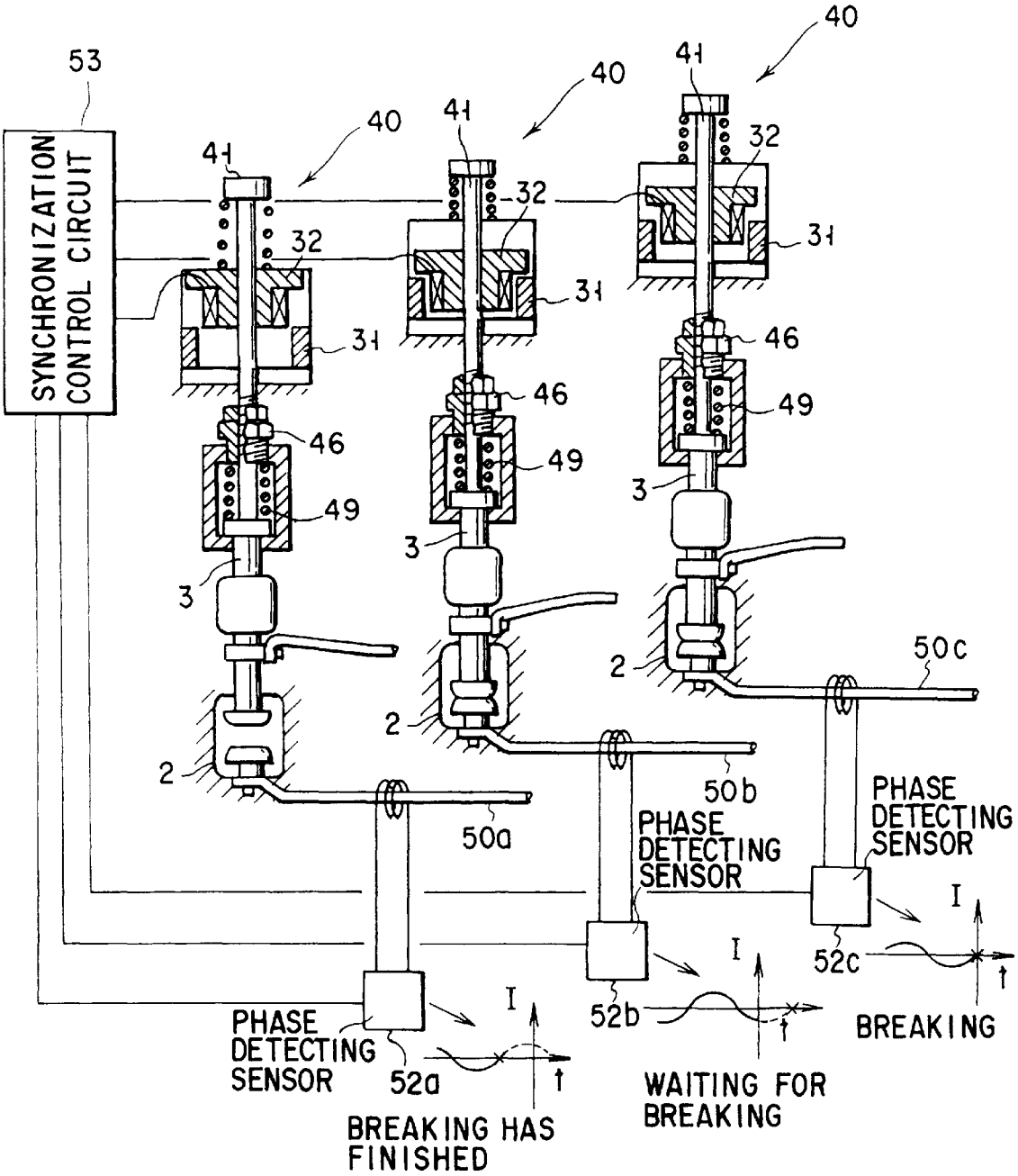
FIG. 15 schematically shows the structure of the operation mechanism of a circuit breaker according to the fifth embodiment of the present invention.

The fifth embodiment of the present invention will be described next, with reference to FIG. 15.

The apparatus of the present embodiment comprises a plurality of the operation apparatuses 40 of the fourth embodiment. In the apparatus of the present embodiment, the operation apparatuses 40 are prepared in parallel corresponding to the number of the phases of the alternate current source (i.e., the number of the vacuum circuit breakers) are arranged. The apparatus of the present embodiment corresponds to the three-phase current source, and thus comprises three operation apparatuses 40.

The apparatus of the present embodiment has detecting sensors 52*a*–52*c* for detecting the conditions of the alternate currents by magnetostriction detection the deflection faces of optical fibers wound around the wires 50*a*–50*c* extending from the fixed contact 2*a,* and a synchronization control apparatus 53 for controlling the operation apparatuses 40 on the basis of the detection signals output from the detecting sensors 52*a*–52*c*.

When the 0 point-cross timing of the alternate currents are detected by the detecting sensors 52*a*–52*c*, the synchronization control apparatus 53 energizes the operation electromagnets 32 of the operation apparatuses 40 to generate repulsion forces, in order, in accordance with the detection signal of the detecting sensors 52*a*–52*c*, to open each vacuum circuit breaker 2. The phases of the alternate currents are shifted by 120° from each other, and thus the operation apparatuses 40 serially operate at predetermined intervals.

With such a structure, the vacuum circuit breakers 2 can be opened at the 0 point-cross timings in order of the phase, with little alternate current flowing through the apparatus. Therefore, the circuit breaking capacity of each vacuum circuit breaker 2 can be decreased.

With such a structure, the vacuum circuit breaker can be opened immediately even if the operation electromagnet 32 has a small capacity.

[The sixth embodiment]

The sixth embodiment of the present invention will be described next, with reference to FIG. 16.

The operation apparatus 60 of this embodiment is designed to operate three vacuum circuit breakers, as described in the fifth embodiment, but differs from the apparatus of the fifth embodiment in simultaneously operating the three valves 2 with use of one mobile member 41. The elements described in the fourth and fifth embodiments will be denoted by the same reference numerals as in the fourth and fifth embodiments, and the detailed description thereof will be omitted.

Figure 16:
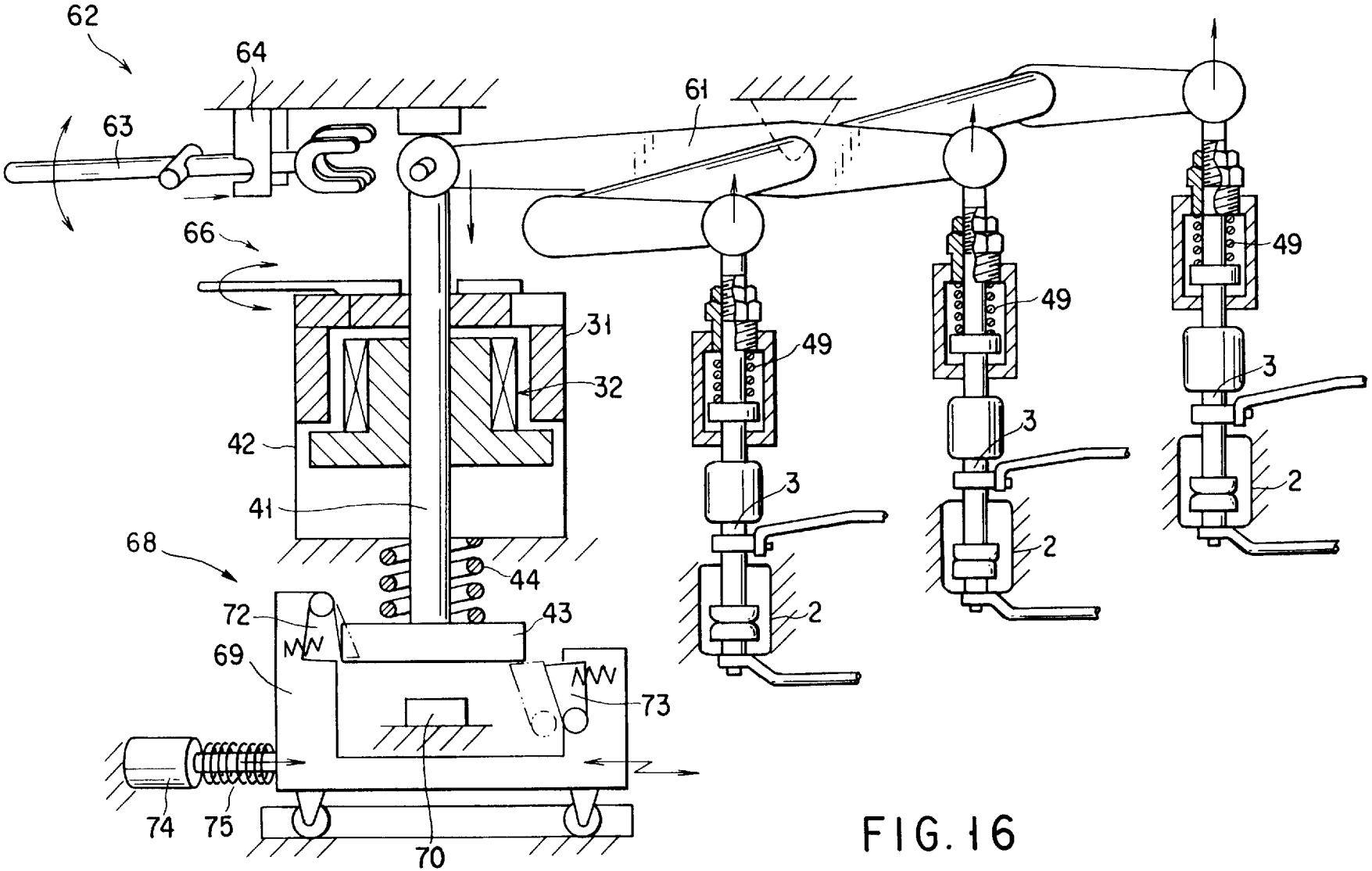
FIG. 16 schematically shows the structure of the operation mechanism of a circuit breaker according to the sixth embodiment of the present invention.

The operation apparatus 60 of this embodiment is designed to simultaneously operate three vacuum circuit breakers 2 with use of one mobile member 41, and thus the mobile member 41 is connected to a driving crank denoted as 61 in FIG. 16, in order to simultaneously drive three operation rods 3 with use of three wiping springs 49. The mobile member 41 and the surrounding members thereof are arranged in a vertically reverse position of that of the fourth embodiment, and the driving crank 61 is attached to the upper end portion of the mobile member 41.

This drawing also shows a manual breaker opening mechanism denoted as 62 for manually performing the opening of the vacuum circuit breakers 2. The manual breaker opening mechanism 62 has a lever 63 for pushing down the mobile member 41 by leverage, and a supporting member 64 for supporting the lever 63 such that the lever 63 can freely swing. The distal end portion of the lever 63 is designed to be coupled with the coupling axis provided to the upper end portion of the mobile member 41 when the lever 63 is driven forward. After the distal end portion of the lever 63 is coupled with the coupling axis, the lever 63 is driven upward with respect to the supporting point of the supporting member 64, thereby the operation rods 3 can be driven upward to open the vacuum circuit breakers 2.

At the upper end portion of the supporting frame 42, a magnetic path breaking mechanism 66 is provided to prevent the permanent attraction force FM from being generated by opening the magnetic path of the permanent magnet 31. When the magnetic path breaking mechanism 66 operates to stop the attraction force of the permanent magnet 31 in the condition where the vacuum circuit breakers 2 are closed (as shown in FIG. 16), the operation rod 3 is moved by the recovering force of the wiping spring 49 and the driving spring 44 in the direction to open the vacuum circuit breaker 2, and thus the opening of the vacuum circuit breakers 2 can be performed.

The apparatus of the present embodiment further comprises a catching mechanism shown in the drawing by reference numeral 68. The catching mechanism 68 is provided to prevent the mobile member 41 from jumping back by the reaction of the operation to move in the opposite direction when the closing or the opening operation is performed.

The catching mechanism 68 comprises a carriage 69 provided movably in the horizontal direction, a cushion member 70 provided to the carriage 69, the first crawl 72 which is provided to the carriage 69, to restrict the upward moving of the stopper 43 though the first crawl allows the downward moving of the stopper 43, the second crawl 73 which restricts the downward moving of the stopper 43 though it allows the upward moving of the stopper 43.

The first and second crawls 72 and 73 are apart from each other by the distance larger than the width of the stopper 43 so as not to simultaneously operate. The operations of the crawls are switched by the horizontal movement of the carriage 69. The carriage 69 can be moved to a desired position by a driving cylinder apparatus 74 and a spring 75.

With such a structure, the closing/opening of a plurality of vacuum circuit breakers 2 can be performed by using only one mobile member 41, and thus the structure of the apparatus can be made simple. Further, the wiping spring 49 is provided to each vacuum circuit breaker 2, and thus the fixed contact 2*a* and the mobile contact 2*b* can be applies with a necessary pressure independently from the contacts of the other two apparatuses even if the fixed contacts 2*a* and the mobile contacts 2*b* of the three apparatuses are transformed/worn down in different manners.

Further, this apparatus is provided with various manual breaker opening means (62, 66), and thus the opening of the vacuum circuit breakers 2 can be performed even if the operation electromagnet cannot be operated due to the error in the power supply or the breakage of the wiring. As a result, the apparatus increases in reliability.

In addition, the catch mechanism 69 prevents the mobile member 41 from moving in the opposite direction due to the reaction of the operation, and thus the troubles such as the chattering in the closing operation and the re-closing in the opening operation will not occur.

[The seventh embodiment]

The seventh embodiment of the present invention will be described next, with reference to FIG. 17.

Figure 17:
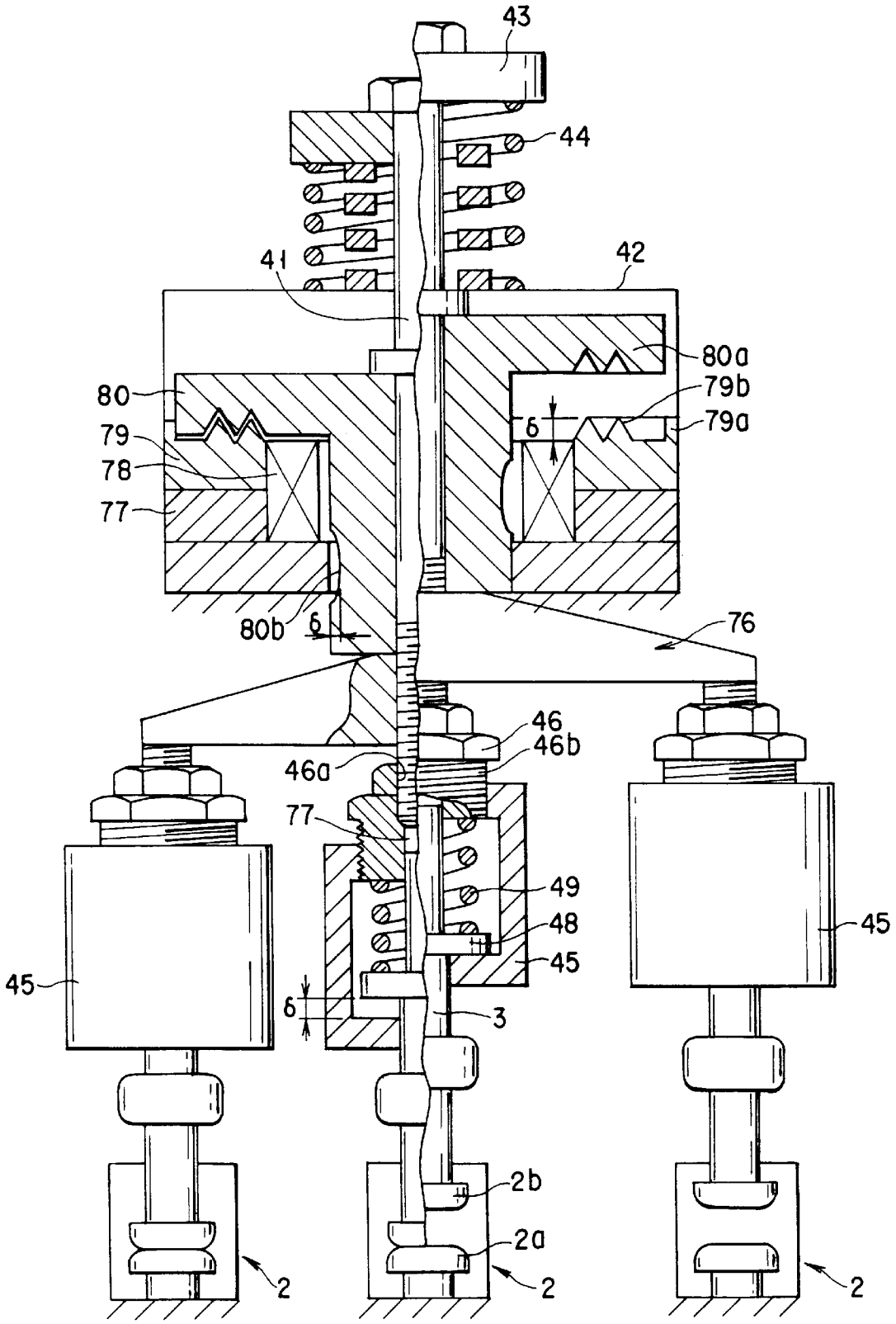
FIG. 17 schematically shows the structure of the operation mechanism of a circuit breaker according to the seventh embodiment of the present invention.

FIG. 17 shows the opened vacuum circuit breaker on the right side of a wave line, and the closed vacuum circuit breaker on the left side. The elements described in the fourth to sixth embodiments will be denoted by the same reference numerals as in the embodiments, and the detailed description thereof will be omitted.

Similarly to the apparatus of the sixth embodiment, the operation apparatus of the present embodiment performs the closing/opening operation of three vacuum circuit breakers 2 with use of only one mobile member 41. In the apparatus of the present embodiment, a simple connecting girder 76 is used instead of the driving crank 61 as described in the sixth embodiment.

Further, the operation apparatus of the present embodiment has a permanent magnet 77 and an operation electromagnet 78 which are attached to one holding member 79 arranged in the supporting frame 42. On the side of the mobile member 41, a magnetic substance 80 is provided to form a simple magnetic path.

The holding member 79 is provided with a protruding thin engaging section 79*a* which can be inserted into a gap between the supporting frame 42 and the mobile member 41, i.e., the gap formed in the magnetic paths. The upper surface of the holding member 79 and the lower surface of the magnetic substance 80 face each other and area formed to have notches 79*b* and 80*a* such that the notches are engaged with each other. The depth/height of the notches 79*b* and 80*a* are set to be substantially the same as the stroke δ by which the wiping spring 49 is stretched out.

The lower end portion of the magnetic substance 80 is also provided at an outer periphery with a recess denoted as 80*b* in the drawing. The recess 80*b* changes the engaging gap between the magnetic substance 80 and the supporting frame 42 within a range represented as g to change the magnetic path formed between the magnetic substance 80 and the holding member 79.

With such a structure, the mobile member 41 is pressed downward by the permanent attraction force generated between the permanent magnet 77 and the magnetic substance 80 when the operation electromagnetic 78 is deenergized. When the vacuum circuit breaker 2 is closed, the magnetic force of the permanent magnet 77 is increased by energizing the operation electromagnet 78. In this manner, the attraction force between the magnetic substance 80 and the permanent magnet increase to drive the mobile member 41 downward.

When the vacuum circuit breaker 2 is closed, the magnetic force of the permanent magnet 77 is decreased by energizing the operation electromagnet 78 such that the mobile member 41 can be moved upward by the recovering forces of the wiping spring 49 and the mobile member driving spring 44.

Between the holding member 79 provided to the supporting frame and the magnetic substance 80 provided to the mobile member 41, a partial increase in a magnetic force will occur due to the function of the thin engaging section 79*a* during the vertical strokes.

Figure 19:
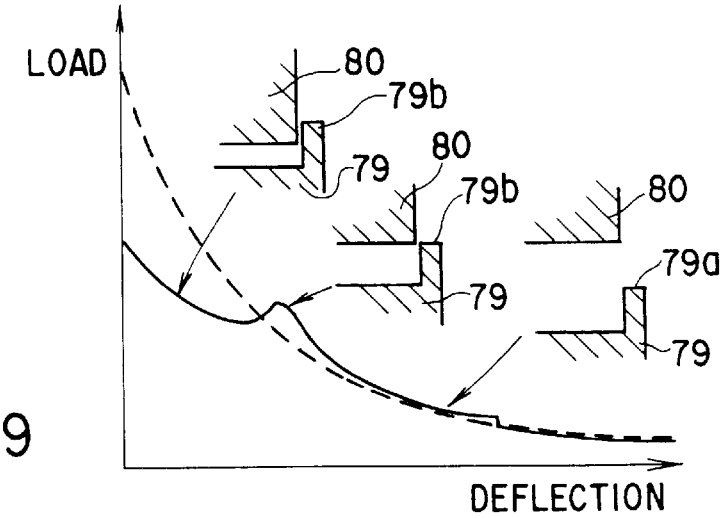
FIG. 19 a graph showing the change in the magnetic force according to the shapes of the magnetic substance used in the seventh embodiment of the present invention.

FIG. 19 is a graph showing the influence on the change of the magnetic force by the protruding thin engaging section 79*a*. A opened curve shows the change of the magnetic force when the thin engaging section 79*a* is not provided to the apparatus. The leak magnetic flux generated by the engaging section 79*a* is limited, and thus the magnetic force will not decreased so remarkably even if the elements are so deeply engaged with each other.

Figure 20:
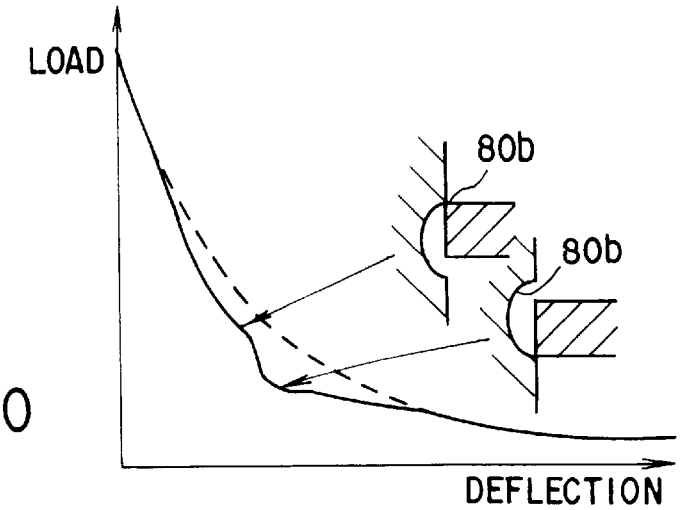
FIG. 20 a graph showing the change in the magnetic force according to the shapes of the magnetic substance used in the seventh embodiment of the present invention.

In addition, the magnetic forces generated between the holding member 79 and the mobile member 41 change due to the change of the engaging gap g formed by the recess 80*b* during the strokes. FIG. 20 is the graph showing the influence on the change in the magnetic force by these members. The opened curve in the graph shows the change of the magnetic force when the recess 80*b* is not formed in the apparatus.

Figure 18:
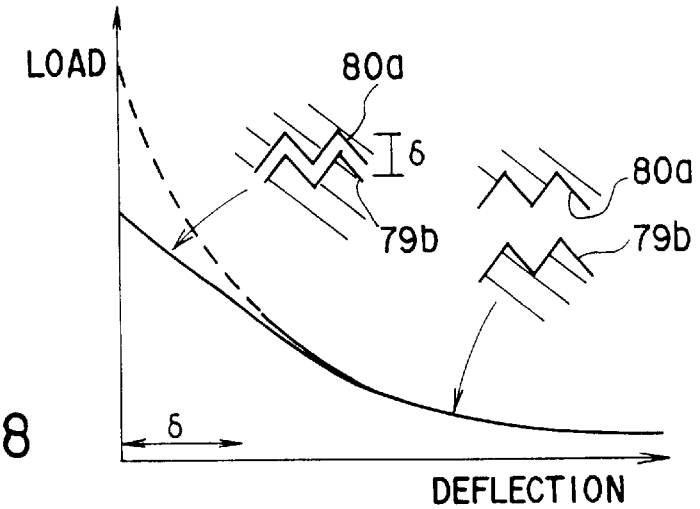
FIG. 18 is a graph showing the change in the magnetic force according to the shapes of the magnetic substance used in the seventh embodiment of the present invention.
Figure 21:
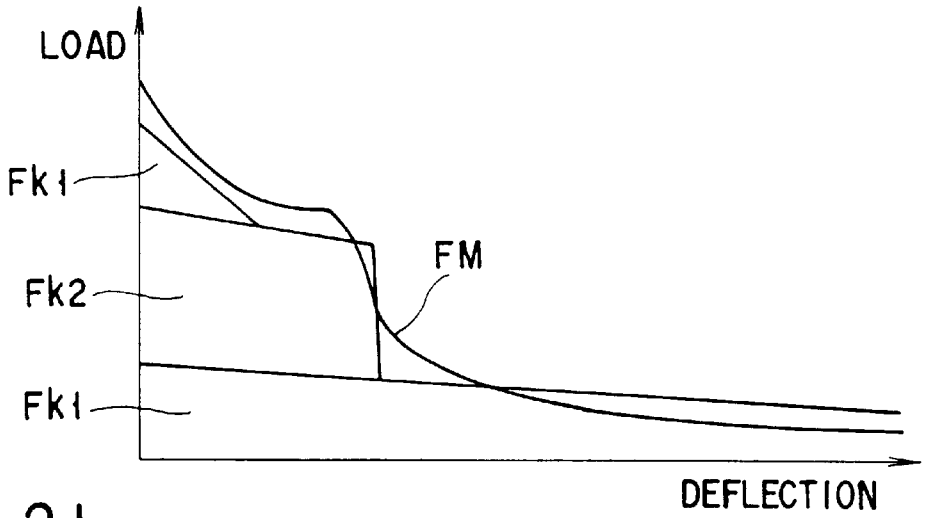
FIG. 21 a graph showing the change in the magnetic force according to the shapes of the magnetic substance used in the seventh embodiment of the present invention.

The change in the magnetic force lines generated in the stroke δ during which the notches 79*b* and 80*a* formed between the holding member 79 and the magnetic substance 80 face each other is small by virtue of the notches 79*b* and 80*a*. FIG. 18 is a graph showing this condition. In this graph, an opened curve shows the case where the notches 79*b* and 80*b* are not provided to the apparatus. As should be clear from this graph, the apparatus can generate substantially the same attraction force constantly within the range of δ. Accordingly, the attraction force can be balanced even if a spring having a low and substantially constant spring constant is used as the wiping spring 49. FIG. 21 shows the characteristics of the load applied to the spring versus the deflection of the spring when a spring having a low and substantially constant spring constant is used as the wiping spring 49.

With the structure as described above, the change in the pressure by the contacts can be suppressed even if the fixed contact and the mobile contact is badly transformed and worn out, and the reliability of the apparatus is increased thereby.

The following is the description of the effect of the thin engaging section 79*a* and the recess 80*b,* and the notches 79*b* and 80*a*.

As described in the first embodiment, the recovering forces of the wiping spring 49 and the mobile member driving spring 44 are set to be substantially the same as the attraction force of the permanent magnet 77 so that the circuit opening/closing of the vacuum circuit breaker can be performed with a small driving force.

The characteristics Fk2 of the wiping spring 49 is, however, determined in accordance with the type of the vacuum circuit breaker 2. Therefore, the recovering forces of the wiping spring 49 and the mobile member driving spring 44 can be set to be substantially the same as the magnetic property FM of the permanent magnet merely by changing the characteristics Fk1 of the wiping spring 49. As should be clear from this, the design margin of the recovering forces is small.

In this embodiment, the permanent attraction force characteristics FM is controlled by providing the apparatus with the thin engaging section 79*a,* the recess 80*b,* and the notches 79*b* and 80*a*. By providing the thin engaging section, the recess, and the notches, the design margin for the wiping spring 49 and the mobile member driving spring 44 is increased, and the total sum of the recovering forces (Fk1+Fk2) of the springs can be easily set to be substantially the same as the permanent attraction force characteristics FM.

Further, with the structure described in the present embodiment, the permanent magnet 77 and the operation electromagnet 78 are integrally fixed to the apparatus and do not move. There is thus little possibility that the permanent magnet 77 may be damaged or the wiring connected to the operation electromagnet 78 may damaged to be crashed. Accordingly, the reliability of the apparatus will increase.

[The eighth embodiment]

Figure 22:
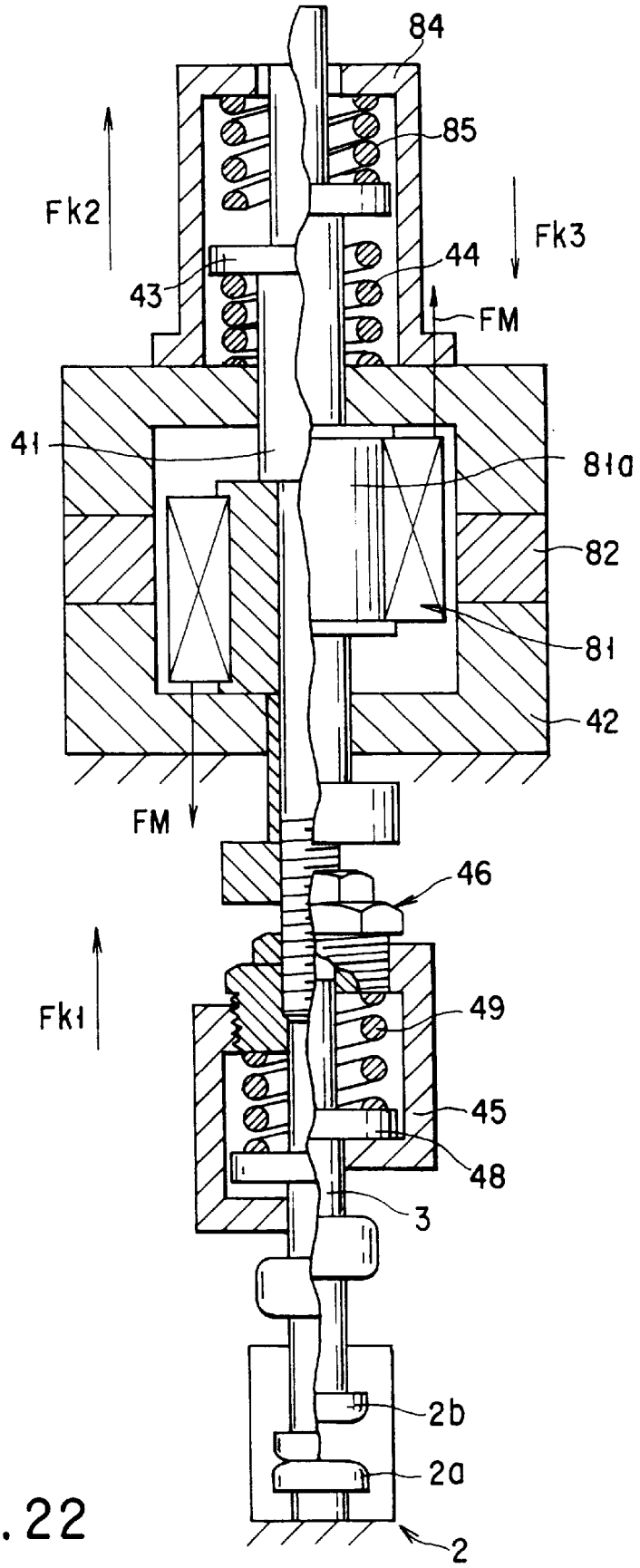
FIG. 22 schematically shows the structure of the operation mechanism of a circuit breaker according to the eighth embodiment of the present invention.
Figure 24:
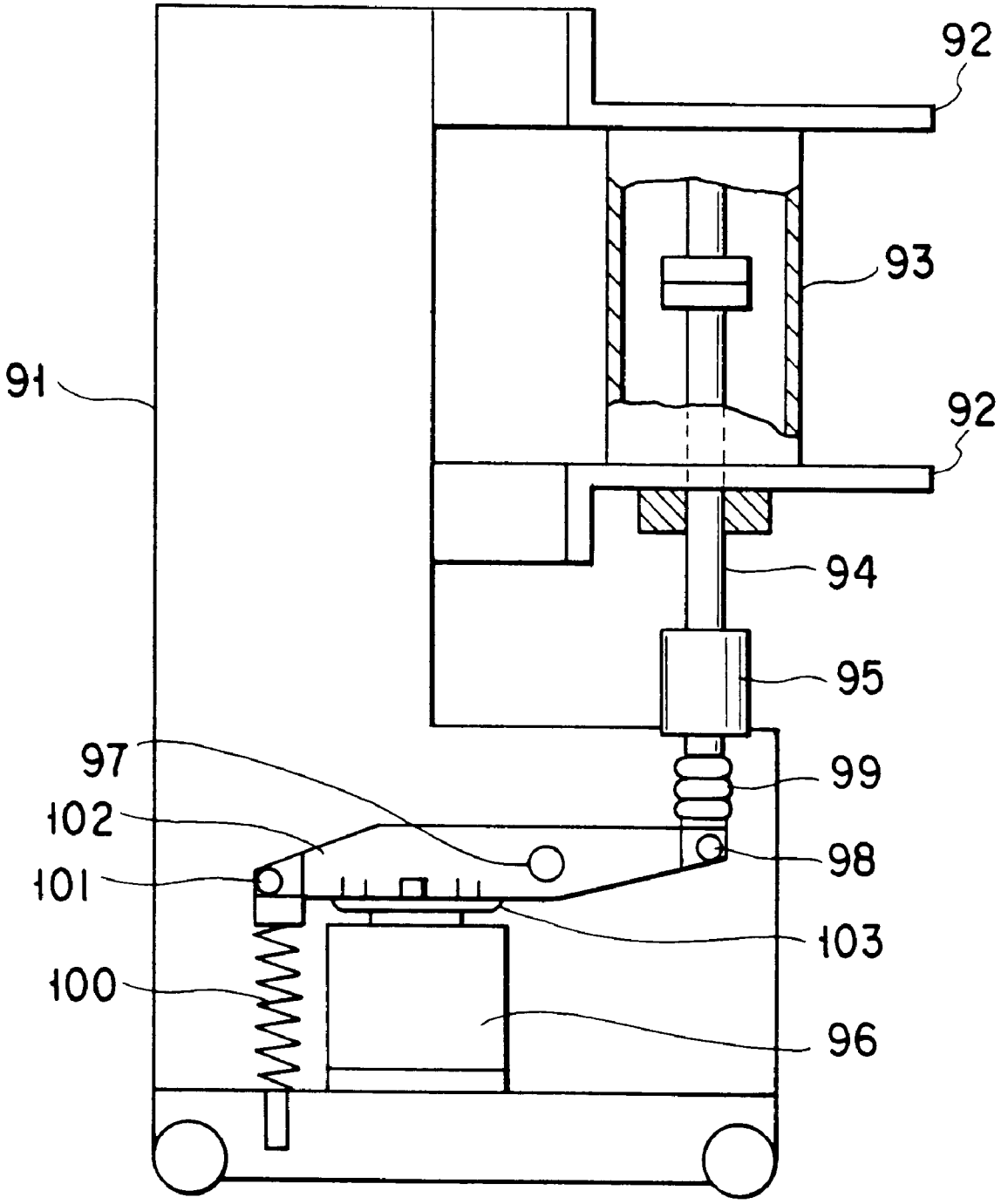
FIG. 24 PRIOR ART
FIG. 24 schematically shows the structure of the conventional operation mechanism of a circuit breaker according to the eighth embodiment of the present invention.

The following is the description of the eighth embodiment of the present invention with reference to FIG. 22.

In FIG. 22, the right side of the apparatus divided by a wave line shows the condition where the vacuum circuit breaker 2 is opened, and the left side of the apparatus shows the condition where the vacuum circuit breaker 2 is closed. The elements described in the fourth embodiment will be denoted by the same reference numerals as in the fourth embodiment, and the detailed description thereof will be omitted.

The apparatus has an operation electromagnet 81 fixed to the side of the mobile member 41, and a permanent magnet 82 fixed on the side of the supporting frame 42. The sizes and the positional relationship of the operation electromagnet 81 and the permanent magnet 82 are set such that the mobile member 41 constantly is pressed in the closing/opening direction by the permanent attraction force exerted by the permanent magnet 82 to the operation electromagnet 81 (iron core 81*a*). More specifically, the mobile member 41 is pressed in the opening direction by the permanent magnet 82 when the mobile member 41 is positioned on breaker opening side with respect to the central position. When the mobile member 41 is positioned on the side of closing, the mobile member 41 is pressed in the closing direction.

Further, the supporting frame 42 of this embodiment is provided with a cover 84 fixed to the upper surface, to cover the upper end portion. This cover 84 contains therein a mobile member driving spring 85 for urging upward the stopper 43 which is provided to the upper end portion of the mobile member 41. Assuming that the spring 44 for urging the mobile member 41 upward is the first mobile member driving spring, and the mobile member driving spring 85 is the second mobile member driving spring, the recovering force of the first mobile member driving spring 44 is Fk2,and the recovering force of the second mobile member driving spring 85 is Fk3.

Figure 23:
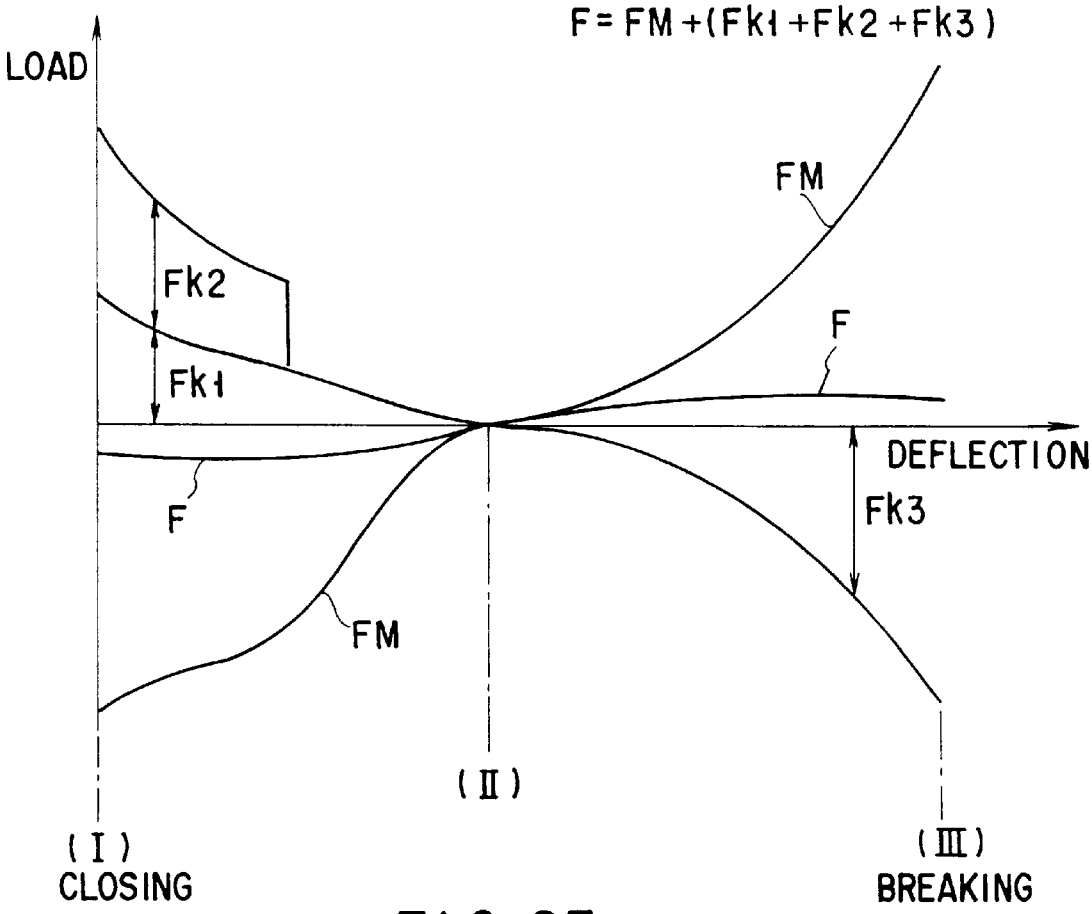
FIG. 23 is a graph showing the relationship between the force applied to the mobile member and the stroke distance of the mobile member according to the eighth embodiment of the present invention.

In this time, the recovering forces Fk2 and Fk3, the recovering force Fk1 of the wiping spring 49, and the permanent attraction force FM of the permanent magnet 82 are set as shown in the graph of FIG. 23. In this graph, (I) represents the condition of the forces when the vacuum circuit breaker is closed, (III) represents the condition of the forces when the vacuum circuit breaker is opened. (II) represents the medium condition of (I) and (III).

In this graph, the maximum length of the first mobile member driving spring 44 is set to be the same as the moving distance of the mobile member 41 during the period between the conditions (I)–(II), and the maximum length of the second mobile member driving spring 85 is set to be the same as the moving distance of the mobile member 41 during the period between the conditions (II)–(III).

F in FIG. 23 shows the total sum of the forces to satisfy the relationship F=FM+(Fk1+Fk2+Fk3). The total force is set to be maintained substantially 0. In the other words, the change characteristics of the total force F is substantially the same as that of the total sum of the forces Fk1, Fk2, and Fk3.

Also with such a structure, substantially the same effect as that of the first embodiment can be attained.

In addition thereto, according to the structure of the present embodiment, a large driving force can be attained in both the breaker opening and the closing directions, and these operations can be performed at a high speed. Further, by changing the height (not shown) of the spring by means of spacers or the like, the recovering forces of the mobile member driving spring and the second mobile member driving spring can be adjusted, and thus the adjustment necessary when the magnetic force of the permanent magnet is deteriorated due to the aged deterioration can be easily performed.

Though a single permanent magnet 82 is provided to the apparatus in this embodiment, the permanent magnet comprising a closing permanent magnet and a breaker opening magnet may be used in the apparatus.

It is understood that the present invention is not limited to the embodiments described above, and that various changes and modifications may be effected therein by one skilled in the art without departing from the range or spirit of the invention. For example, the vacuum circuit breakers are operated in the embodiments, but a gas circuit breaker may be operated by the operation apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An operation apparatus of a circuit breaker provided with a mobile contact and a fixed contact, the mobile contact is pressed against the fixed contact or drawn apart from the fixed contact, comprising:

an operation rod fixed to the mobile contact and held to be movable with respect to the fixed contact;

a mobile member movably connected to the operation rod, a relative movable range of the mobile member to the operation rod being limited within a predetermined value;

a first elastic member for urging the operation rod with respect to the mobile member in a direction in which the mobile contact is pressed against the fixed contact;

a fixed member for movably holding the mobile member;

a second elastic member for urging the mobile member with respect to the fixed member in a direction in which the mobile contact is drawn apart from the fixed contact;

a permanent magnet for driving the mobile member with respect to the fixed member in a direction in which the mobile contact is pressed against the fixed contact;

an operation electromagnet for applying a magnet force to the permanent magnet so as to drive the mobile member; and a power supply circuit for energizing the operation electromagnet.

2. An operation apparatus according to claim 1, wherein the first and second elastic members comprise a non-linear spring member.

3. An operation apparatus according to claim 1, wherein members other than the permanent magnet and the operation electromagnet comprise non-magnetic substances.

4. An operation apparatus according to claim 1, wherein the movable range of the operation rod with respect to the mobile member is set to be smaller than the movable range of the mobile member with respect to the fixed member.

5. An operation apparatus according to claim 1, wherein, where a reaction force applied to the mobile member from the operation rod by virtue of action of the first elastic member is Fk2, a reaction force applied to the mobile member from the fixed member by virtue of action of the second elastic member is Fk1, and an attraction force applied to the mobile member by the permanent magnet is FM when the operation electromagnet is deenergized, change characteristics of a total sum Fk1+Fk2 of the forces Fk1 and Fk2 is substantially equal to that of the force FM within the movable range of the mobile member.

6. An operation apparatus according to claim 5, wherein a relationship among the forces Fk1, Fk2, and FM is set to satisfy FM>Fk1+Fk2 when the mobile contact is pressed against the fixed contact to close the circuit breaker, and when the mobile contact is apart from the fixed contact to open the circuit breaker, the relationship is set to satisfy FM<Fk1+Fk2.

7. An operation apparatus according to claim 1, wherein the permanent magnet is provided to one of the mobile member and the fixed member, and the operation electromagnet is provided to the other one of the mobile member and the fixed member.

8. An operation apparatus according to claim 7, wherein both the permanent magnet and the operation electromagnet are arranged in parallel to each other to form a closed magnetic circuit.

9. An operation apparatus according to claim 1, wherein the permanent magnet and the operation electromagnet are integrally provided to one of the mobile member and the fixed member, and the other one of the mobile member and the fixed member is provided with a magnetic substance for making the magnetic forces of the permanent magnet and the operation electromagnet function.

10. An operation apparatus according to claim 1, wherein the second elastic member is arranged such that an initial recovering force can be adjusted.

11. An operation apparatus according to claim 10, wherein one end portion of the second elastic member is supported by an adjusting member provided to one of the fixed member and the mobile member and the adjustment member can be adjusted in a moving direction of the mobile member, and the second elastic member is provided so that the initial recovering force can be adjusted by adjusting the adjustment member.

12. An operation apparatus according to claim 1, wherein the operation apparatus operates a plurality of circuit breakers, and at least operation rods and first elastic members of a number corresponding to a number of the circuit breakers are provided therein.

13. An operation apparatus according to claim 12, further comprising a detection sensor for detecting a state of an electric current flowing each of the circuit breakers, and a synchronization control circuit for synchronizing a breaker opening timing of the circuit breakers to a timing at which the electric current is set at 0.

14. An operation apparatus according to claim 12, wherein the operation rods are connected to the mobile members of a smaller number than that of the operation rods.

15. An operation apparatus according to claim 1, further comprising a manual opening mechanism capable of manually driving the operation rod and opening the circuit breaker.

16. An operation apparatus according to claim 15, wherein the manual opening mechanism has a driving lever for driving the mobile member by leverage.

17. An operation apparatus according to claim 15, wherein the manual opening mechanism is a magnet path breaking mechanism capable of manually and mechanically breaking a magnet path of the permanent magnet.

18. An operation apparatus according to claim 1, further comprising a reaction prevention mechanism for preventing reaction of the mobile member.

19. An operation apparatus according to claim 1, wherein the reaction prevention mechanism has a cushion member for reducing the reaction of the mobile member.

20. An operation apparatus according to claim 18, wherein the reaction preventing mechanism has a crawl member to be engaged with the mobile member, thereby restricting the reaction of the mobile member.

21. An operation apparatus according to claim 1, wherein the permanent magnet urges the mobile member in the direction in which the mobile contact is drawn apart from the fixed contact when the fixed contact and the mobile contact are apart from each other, the permanent magnet urges the mobile member in the direction in which the mobile contact is pressed against the fixed contact when the fixed contact and the mobile contact are in contact with each other.

* * * * *